US006521085B2

(12) United States Patent
Kumamoto et al.

(10) Patent No.: US 6,521,085 B2
(45) Date of Patent: Feb. 18, 2003

(54) PULP MOLDED ARTICLE

(75) Inventors: Yoshiaki Kumamoto, Haga-gun (JP); Kenichi Otani, Haga-gun (JP); Shinji Otakura, Haga-gun (JP); Tokuo Tsuura, Haga-gun (JP); Masataka Ishikawa, Haga-gun (JP); Toshiyuki Suga, Haga-gun (JP); Akira Nonomura, Haga-gun (JP)

(73) Assignee: Kao Corporation, Tokyo (JP)

( * ) Notice: Subject to any disclaimer, the term of this patent is extended or adjusted under 35 U.S.C. 154(b) by 0 days.

(21) Appl. No.: 09/885,982

(22) Filed: Jun. 22, 2001

(65) Prior Publication Data

US 2001/0040016 A1 Nov. 15, 2001

Related U.S. Application Data

(62) Division of application No. 09/622,043, filed as application No. PCT/JP99/00775 on Feb. 22, 1999.

(30) Foreign Application Priority Data

| | | |
|---|---|---|
| Feb. 23, 1998 | (JP) | 10-40597 |
| Feb. 23, 1998 | (JP) | 10-40697 |
| Feb. 23, 1998 | (JP) | 10-40699 |
| May 29, 1998 | (JP) | 10-186768 |
| Sep. 17, 1998 | (JP) | 10-262970 |
| Sep. 29, 1998 | (JP) | 10-275256 |
| Dec. 28, 1998 | (JP) | 10-373716 |
| Dec. 28, 1998 | (JP) | 10-373717 |
| Feb. 5, 1999 | (JP) | 11-29290 |

(51) Int. Cl.[7] ..... D21J 7/00

(52) U.S. Cl. ..... 162/130; 162/149; 162/219; 162/228; 162/231; 428/34.2

(58) Field of Search ..... 162/115, 116, 162/117, 13, 218–230, 387–416, 123–133, 231; 264/493, 495, 86, 87, 299, 301, 306, 313, 315, 319; 428/35.6, 542.8, 34.2

(56) References Cited

U.S. PATENT DOCUMENTS

| | | | | | |
|---|---|---|---|---|---|
| 2,100,396 | A | * | 11/1937 | Heymann | 162/219 |
| 2,881,669 | A | * | 4/1959 | Thomas et al. | 162/130 |
| 3,594,273 | A | * | 7/1971 | Williams | 162/219 |
| 3,802,963 | A | * | 4/1974 | Lee et al. | 162/219 |
| 3,954,555 | A | * | 5/1976 | Kole et al. | 162/136 |
| 4,455,195 | A | * | 6/1984 | Kinsley | 162/13 |
| 4,798,694 | A | * | 1/1989 | Sugata et al. | 264/60 |
| 4,871,643 | A | * | 10/1989 | Tamagawa et al. | 430/138 |
| 5,047,121 | A | * | 9/1991 | Kochar | 162/146 |
| 5,167,813 | A | * | 12/1992 | Iwata et al. | 210/219 |
| 5,242,546 | A | * | 9/1993 | Evans et al. | 162/146 |
| 5,972,169 | A | * | 10/1999 | Bodary et al. | 162/218 |

FOREIGN PATENT DOCUMENTS

| | | |
|---|---|---|
| JP | 42-9086 | 5/1967 |
| JP | 47-25257 | 8/1972 |

(List continued on next page.)

OTHER PUBLICATIONS

T. Goto, Public Relations Department, Kao Corporation, 4 pages, "Paper–Bottle Molding System", Oct. 25, 2000 (With English Translation).

(List continued on next page.)

*Primary Examiner*—Steven P. Griffin
*Assistant Examiner*—Eric Hug
(74) *Attorney, Agent, or Firm*—Oblon, Spivak, McClelland, Maier & Neustadt, P.C.

(57) ABSTRACT

A method for producing a pulp molded article (7) comprising the steps of supplying a pulp slurry into the cavity (1) of a mold (10) composed of a set of splits (3 and 4) the set of splits (3 and 4) being assembled together to form the cavity (1) with a prescribed configuration, to form a pulp deposited body (5), feeding a fluid into the cavity (1) to press the pulp deposited body (5) onto the inner wall of the cavity (1) for dewatering.

3 Claims, 10 Drawing Sheets

FOREIGN PATENT DOCUMENTS

| | | |
|---|---|---|
| JP | 48-50003 | 7/1973 |
| JP | 50-149460 | 5/1974 |
| JP | 51-139838 | 12/1976 |
| JP | 52-128412 | 10/1977 |
| JP | 54-133972 | 10/1979 |
| JP | 61-174500 | 8/1986 |
| JP | 8-92900 | 4/1996 |
| JP | 8-232200 | 9/1996 |
| JP | 9-309153 | 12/1997 |
| JP | 9-316800 | 12/1997 |
| JP | 10-46500 | 2/1998 |
| JP | 10-131100 | 5/1998 |
| JP | 8-158299 | 6/1999 |

OTHER PUBLICATIONS

U.S. patent application Ser. No. 09/885,982, Kumamoto, filed Jun. 22, 2001, pending.

U.S. patent application Ser. No. 09/889,566, Nonumura, filed Jul. 30, 2001, pending.

U.S. patent application Ser. No. 09/503,083, Nonomura, filed Feb. 14, 2000, pending.

U.S. patent application Ser. No. 09/622,040, Otakura, filed Aug. 23, 2000, pending.

U.S. patent application Ser. No. 09/622,043, Kumamoto, filed Oct. 10, 2000, pending.

U.S. patent application Ser. No. 09/713,230, Nonomura, filed Nov. 16, 2000, pending.

U.S. patent application Ser. No. 09/885,982, Kumamoto, filed Jun. 22, 2001, pending.

* cited by examiner 10
53
51a
54
3
9
4
2
50
51
52
1
5

PULP MOLDED ARTICLE

This application is a Division of application Ser. No. 09/622,043 filed on Oct. 10, 2000, pending which was originally filed as International Application Number PCT/JP99/00775 on Feb. 22, 1999.

TECHNICAL FIELD

The present invention relates to a method for producing pulp molded articles that can be used as, for example, packaging members such as containers and cushioning materials.

BACKGROUND ART

Plastics are used as general materials of packaging containers, for example, those with a lid and bottles, for their excellent molding properties and productivity. However, because plastic containers involve various problems associated with waste disposal, pulp molded containers formed by pulp molding have been attracting attention as substitutes for plastic containers. Pulp molded containers are not only easy to dispose of but economically excellent because they can be manufactured by using recycled paper.

The following process is known as one of the methods for producing the pulp molded containers. A pulp slurry is poured into a split mold, for example, a pair of splits, which has a plurality of holes interconnecting the outside of the mold to the cavity and which is lined with a metal net, and the split mold is evacuated from the outside to deposit pulp fiber on the metal net thereby to form a pulp deposited body. After the pulp deposited body is shaped in conformity to the configuration of the split mold cavity, a pulp molded container made of the thus shaped pulp deposited body is removed from the mold and dried.

In the above process, however, the pulp deposited body should be taken out while having a considerably high water content, or the pulp deposited body needs a long time for dehydration and drying. Therefore, the pulp molded container is liable to deformation, and productivity is low due to poor drying efficiency. As a result, the pulp molded container is uncompetitive in price.

Japanese Patent Application Laid-Open No. 133972/9 discloses a process for producing a pulp molded container which comprises ejecting a pulp slurry from a special nozzle into a net mold, blowing high-pressure air to remove a considerable part of the water content, followed by removal from the mold and drying with hot air, infrared rays, etc.

However, having no step of bringing the pulp deposited body into intimate contact with the mold surface (pressing onto the mold surface), the above process fails to make a complicated shape and involves great variations of precision in product shape and dimension. Moreover, the drying efficiency is poor, and the product wall thickness (basis weight or density) is uncontrollable.

Accordingly, an object of the present invention is to provide a method for producing a pulp molded article by which a pulp molded article of complicated shape can be obtained by integral molding with no seams at the mouth portion, the body, and the bottom portion.

DISCLOSURE OF THE INVENTION

The present invention has achieved the above object by providing a method for producing a pulp molded article comprising the steps of supplying a pulp slurry into the cavity of a mold composed of a set of splits, the set of splits being assembled together to form the cavity with a prescribed configuration, to form a pulp deposited body, feeding a fluid into the cavity to press the pulp deposited body onto the inner wall of the cavity thereby to dewater the deposited body, said pulp slurry containing pulp fibers having an average fiber length of 0.8 to 2.0 mm, a Canadian Standard Freeness of 100 to 600 cc, and such a frequency distribution of fiber length as comprises 20 to 90%, based on the total fiber, of fibers whose length ranges longer than 1.4 mm and not longer than 3.0 mm.

BEST MODE FOR CARRYING OUT THE INVENTION

Figure 1:
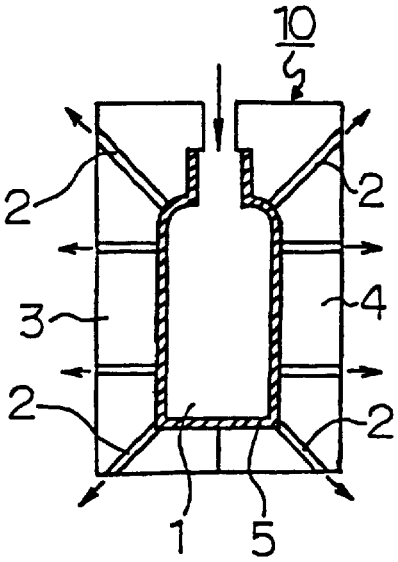
FIG. 1(*a*), FIG. 1(*b*), FIG. 1(*c*), FIG. 1(*d*) and FIG. 1(*e*) schematically show a first embodiment of the present invention, wherein FIG. 1(*a*) is the step of papermaking, FIG. 1(*b*) is the step of inserting a pressing member, FIG. 1(*c*) is the step of pressing, dewatering, and drying, FIG. 1(*d*) is the step of opening the mold, and FIG. 1(*e*) is the step of removing a pulp molded article.
Figure 1:
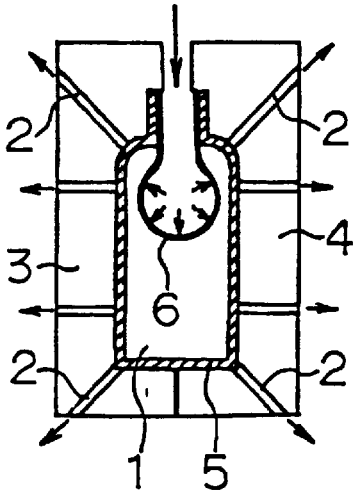
Figure 1:
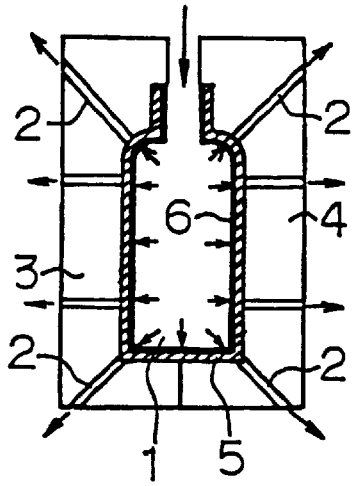
Figure 1:
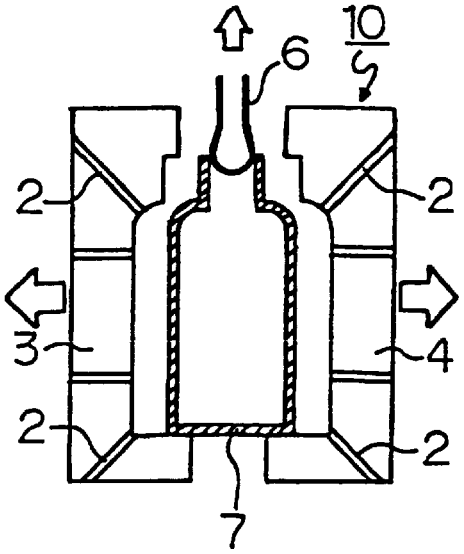
Figure 1:
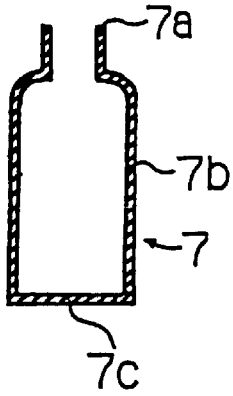

Specific embodiments in the practice of the present invention are described below in detail by referring to drawings. To begin with, a first embodiment is described with reference to FIG. 1.

The method for producing a pulp molded article according to this embodiment is characterized by comprising injecting a pulp slurry into the cavity 1 of a mold 10 composed of a set of splits 3 and 4, the set of splits being butted together to form a cavity of prescribed shape, evacuating the split mold 3 and 4 to deposit pulp fibers on the inner wall of the split mold 3 and 4 to form a pulp deposited body 5, inserting an elastic and stretchable pressing member 6 inside the split mold 3 and 4, feeding a fluid into the pressing member 6 to inflate the pressing member 6, pressing the pulp deposited body 5 with the inflated pressing member 6 onto the inner wall of the split mold 3 and 4 thereby to press, dewater, and dry the pulp deposited body 5, withdrawing the fluid from the pressing member 6, and removing a pulp molded article 7 from the splits 3 and 4. The splits 3 and 4 each have a plurality of interconnecting holes 2 which connect the outer side thereof and the cavity 1.

The method of producing the pulp molded article according to this embodiment will further be described in the concrete with reference to FIG. 1. As shown in FIG. 1(*a*), a pulp slurry is injected into a split mold for papermaking made of a pair of splits 3 and 4 having a plurality of interconnecting holes 2 interconnecting the outer side of the splits 3 and 4 to the cavity 1. The pulp slurry is a dispersion of pulp fiber in water. The pulp fiber is preferably wood pulp, such as soft wood pulp and hard wood pulp, or non-wood pulp, such as bamboo and straw. The pulp fibers preferably have a length of 0.1 to 10.0 mm and a thickness of 0.01 to 0.05 mm. A particularly preferred composition of the pulp slurry will be described later.

In this particular embodiment, a cylindrical bottle whose opening (mouth) has a smaller diameter than its body is produced by using splits 3 and 4 providing a cavity configuration in conformity to the contour of the bottle.

As shown in FIG. 1(*a*), the split mold 3 and 4 is evacuated from the outside of the splits 3 and 4 to build up pulp fiber on the inner wall of the split mold. A pulp deposited body 5 built up of the pulp fiber is thus formed on the inner wall of the split mold.

Then, the elastic and stretchable pressing member 6 is inserted into the cavity 1 while evacuating the cavity 1 as shown in FIG. 1(*b*). The pressing member 6 is used as inflated in the cavity like a balloon thereby to press the pulp deposited body 5 onto the inner wall of the split mold while dewatering thereby to transfer the inner configuration of the split mold to the pulp deposited body. It is therefore preferably made of urethane, fluorine or silicone rubber, elastomers, etc., which are excellent in tensile strength, impact resilience and stretchability. The pressing member 6 may be a hollow bag having no elasticity, in which case, too, the pressing member is inserted into the split mold 3 and 4 to press the pulp deposited body 5 onto the inner wall of the split mold whereby the inner configuration of the split mold can be transferred to the pulp deposited body 5. The pressing member 6 of bag form is made of, for example, a synthetic resin film such as a polyethylene film or a polypropylene film, a synthetic resin film having aluminum or silica deposited, a synthetic resin film laminated with aluminum foil, paper, fabrics, and the like. The bag should be equal to or greater in size than the inner contour of the pulp deposited body 5. It is possible that the pressing member is not taken out after pressing the pulp deposited body 5 and left there as a liner of the pulp deposited body.

As shown FIG. 1(*c*), a fluid is fed into the pressing member 6 to inflate the pressing member 6. The inflated pressing member 6 presses the pulp deposited body 5 to the inner wall of the split mold to dewater under pressure. While the pulp deposited body 5 is pressed onto the inner wall of the split mold by the inflated pressing member 6, the configuration of the inner wall of the split mold is transferred thereto. Since the pulp deposited body 5 in the cavity 1 is pressed to the inner wall of the split mold in this manner, the inner side configuration of the split mold can be transferred to the pulp deposited body 5 with good precision however complicated the configuration may be. The above-described fluid includes compressed air, oil and other liquids. The pressure for fluid feed is preferably $9.8\times10^3$ Pa to $49.0\times10^5$ Pa. Under a pressure lower than $9.8\times10^3$Pa, the pressing member 6 may fail to press the pulp deposited body 5 to the inner wall of the split mold. Under a pressure exceeding $49.0\times10^5$ Pa, the pulp deposited body 5 may be collapsed by the pressing member 6.

Being pressed in the split mold 3 and 4 which is in a heated state, the pulp deposited body 5 is pressed, dehydrated, and dried. Thereafter the fluid is withdrawn from the pressing member 6, whereupon the pressing member 6 shrinks by its own elastic force as shown in FIG. 1(*d*). The shrunken pressing member 6 is taken out of the split mold 3 and 4, and the split mold 3 and 4 is opened to remove the pulp molded article 7. It is preferred for the fluid be pressurized so as to shorten the time for feeding and discharging the fluid in and out of the pressing member 6. It is also preferred for the fluid be heated so as to shorten the drying time.

The pulp molded article 7 thus produced is a cylindrical bottle whose opening portion 7*a* (neck) has a smaller diameter than the body 7*b*. The neck 7*a*, the body 7*b*, and the bottom 7*c* are integrally unified with no seams. Having no joint seams on the outer surface, the pulp molded article 7 obtained by the method of the present invention has an excellent outer appearance.

According to the above-described embodiment, since the pulp molded article 7 is taken out after completion of drying and dehydration, the drying efficiency is high, the productivity is excellent, and deformation of the container can be prevented. According to this embodiment, because the pressing onto the inner wall of the split mold is under control, it is possible to impart a complicated shape, there is no scatter of shape and dimensional precision, and the drying efficiency is good. Further, it is possible to control the thickness and the basis weight, which enables strength design in designing the pulp molded article 7. Furthermore, this embodiment provides a container having beautiful appearance on both the outer and inner sides thereof with satisfactory surface properties.

The above-described embodiment provides molded articles having complicated shapes, including, for example, not only containers having a large height (60 mm or more) and those having no draft but those formed of three-dimensional curved surfaces, those with or without a bottom, and the like. Molded articles that can be produced include a bottomless hollow container that is straight (no draft angle) and as high as 60 mm or more, a bottomless hollow container having a dent in its middle with a three-dimensional curve, and a bottomless hollow container having a plurality of projections on the outer side around the lower edge thereof with a three-dimensional curve. Also included are a closed-end hollow container which is straight with no draft angle and whose opening is substantially equal to the bottom in diameter and a closed-end hollow container like a mortar whose opening has a larger diameter than the bottom. Additionally included are a closed-end or bottomless container whose opening has a smaller diameter than the body, a closed-end cylindrical hollow container having a relief pattern on its surface, a closed-end hollow container having a dent in the middle, a closed-end hollow container whose outer diameter gradually decreases from the opening to the bottom, and a closed-end hollow container whose outer diameter gradually increased from the opening toward the bottom.

While in the above-described embodiment pressure dewatering and heat drying of the pulp deposited body 5 are carried out in the same mold, these operations may be conducted in separate molds. In detail, after a pulp deposited body 5 is formed as shown in FIG. 1(*a*), a pressing member 6 is inserted into the cavity 1 as shown in FIG. 1(*b*). A pressurizing fluid is fed into the pressing member 6 whereby the pulp deposited body 5 is pressed onto the inner wall of the cavity 1 and dewatered under pressure. The mold 10 used here is not heated. On dewatering the pulp deposited body 5 to a predetermined water content, the split mold 3 and 4 is opened to take out a wet pulp preform. The pulp preform is set in a separately prepared heating mold (not shown) which is composed of a set of splits and heated to a predetermined temperature, where the preform is dried under heat. The heat drying can be accelerated by inserting a pressing member similar to the pressing member 6 used in the above-mentioned pressure dewatering into the cavity of the heating mold and feeding a pressurizing fluid into the pressing member to inflate the pressing member thereby pressing the wet preform onto the inner wall of the heating mold cavity.

In carrying out pressure dewatering and heat drying in separate molds, the cavity configuration of the mold for pressure dewatering is not particularly limited as long as the cavity configuration of the heated mold for heat drying is in conformity to the outer contour of a molded article to be made.

In the embodiment depicted in FIGS. 1(*a*) through (*e*) the pressing member 6 which is elastic and stretchable may be replaced with a previously molded closed-end parison (preformed parison) comprising a thermoplastic resin in a heated state to a predetermined temperature.

In some detail, the above-mentioned parison is a previously molded cold parison of a thermoplastic resin, which has a screw thread around its neck. The thermoplastic resins preferably include polyethylene, polypropylene, and polyethylene terephthalate. A preferred parison heating temperature is 120 to 140° C. in case of using polypropylene or 100 to 130° C. in case of using polyethylene terephthalate.

A parison heated to a predetermined temperature is inserted into the cavity in place of the pressing member 6 shown in FIG. 1(*b*). Subsequently, a pressurizing fluid is fed into the parison to inflate it, and the pulp deposited body is pressed onto the inner sides of the split mold by the inflated parison whereby the pulp deposited body is pressure dewatered and heat dried. Thus, the thermoplastic resin film is formed in intimate contact with the inner surface of the pulp deposited body 5 simultaneously with the shaping, dewatering, and drying of the pulp deposited body 5. According to this method, since lining with the thermoplastic resin film can be performed simultaneously with the dewatering and drying of the pulp deposited body, the production process can be simplified to bring about improvement in productivity and reduction in cost. Having the thermoplastic resin film as a liner, the pulp molded article 7 produced by this method is excellent in waterproofness, moisture proofness, and gas barrier properties and enjoys a broadened range of application as a container.

Figure 2:
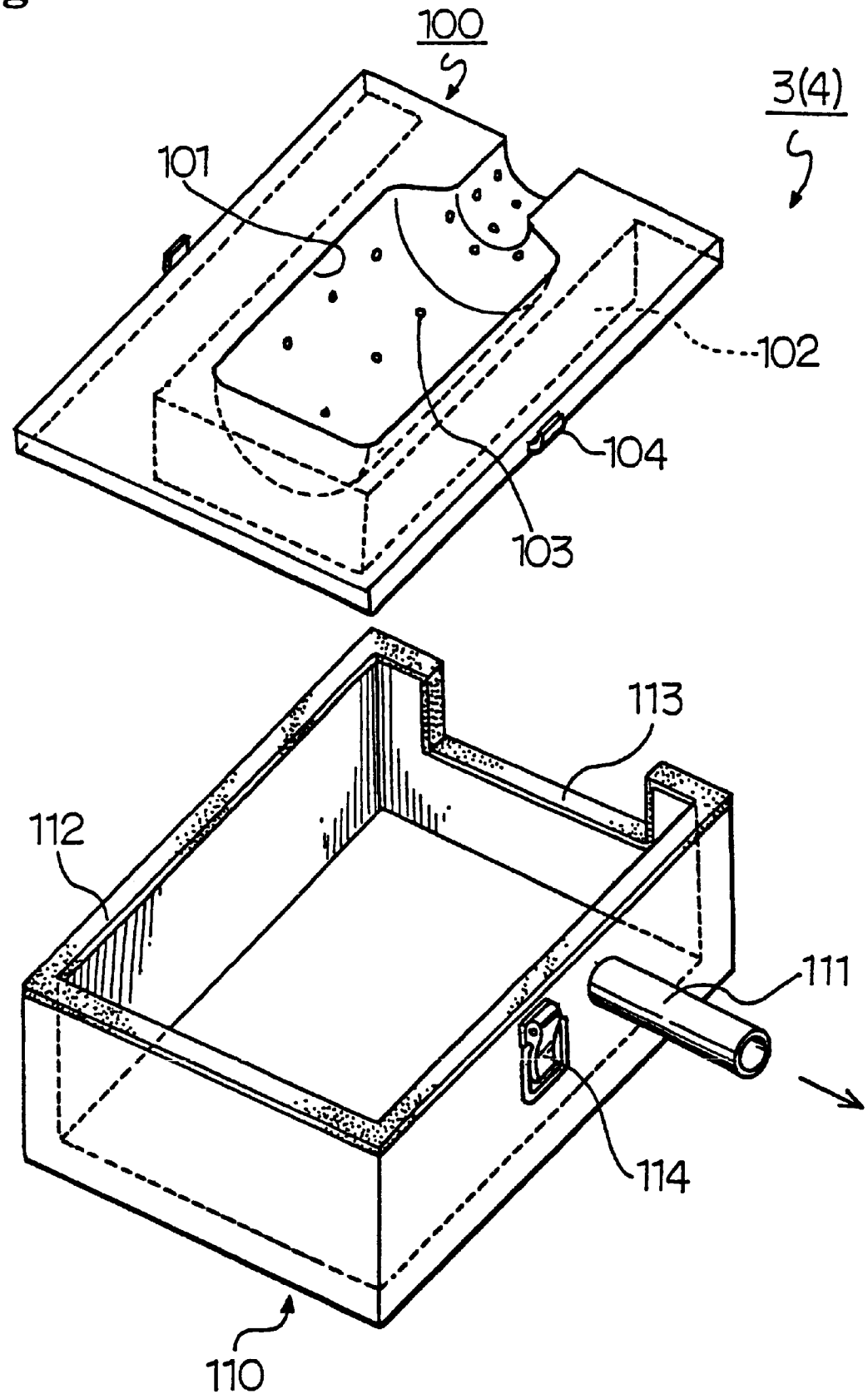
FIG. 2 is a perspective exploded view of a split which is preferably used in the present invention.

FIG. 2 illustrates a split that can be used preferably in the above-described embodiment. This split is constructed of a papermaking part 100 having a cavity 101 to form a pulp deposited body and a manifold part 110 having a vacuum port 111 connecting with the outside. The manifold part 110 is fitted to the back of the cavity 101 to form a hollow chamber, surrounded by the back of the papermaking part 100 and the side walls 112 and the side wall 113 around the opening of the manifold part 110. The block 102 of the papermaking part 100, in which the cavity 101 is engraved, has a plurality of interconnecting holes 103 connecting the cavity 101 to the hollow chamber.

The papermaking part 100 and the manifold part 110 can be exchangeable clamped together by fastening a ring 114 of the manifold part 110 to a hook 104 of the papermaking part 100. The papermaking part 100 varies according to the shape of the pulp molded article, only the papermaking part is changed in changing the kind of the product A sealant is provided on the upper edge of the side walls 112 of the manifold part 110 to prevent reduction of efficiency in evacuating the hollow chamber while the papermaking part 100 and the manifold part 110 are clamped together.

Figure 3:
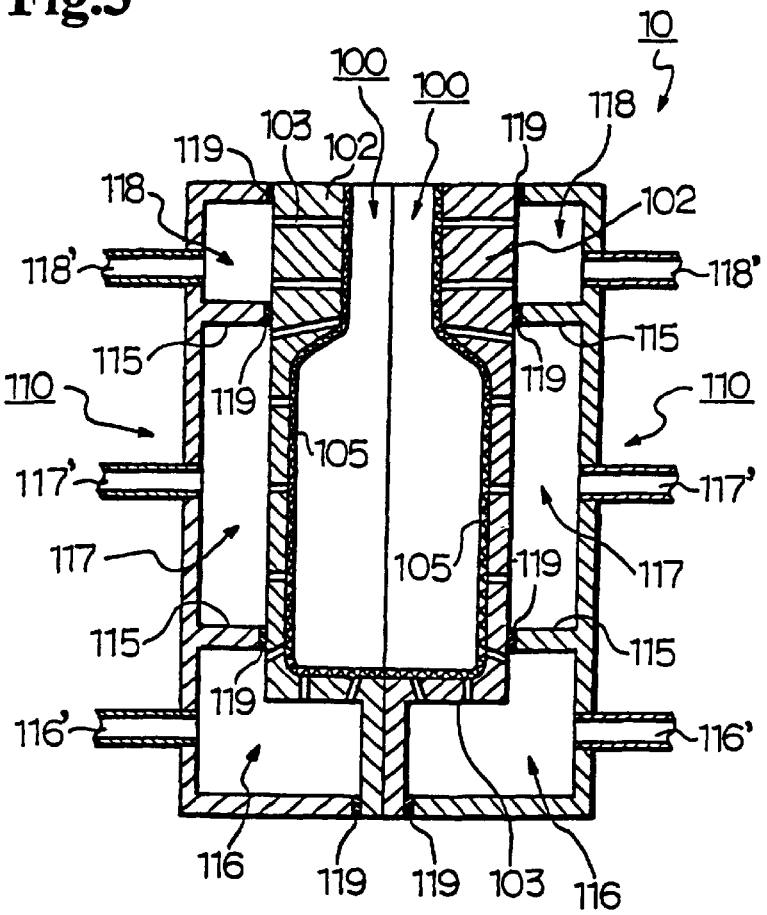
FIG. 3 is a cross sectional view of another split mold which is preferably used in the present invention.

The splits shown in FIG. 3 are also preferred as a modification of the split shown in FIG. 2. The manifold part 110 of the split shown in FIG. 3 has partitioning walls 115 and 115. These partitioning walls divide the hollow chamber into three hollow sub-chambers (a first chamber 116, a second chamber 117, and a third chamber 118), each of which is connected to the cavity through a plurality of interconnecting holes 103. A sealant 119 is provided on the upper edge of each partitioning wall 115 (i.e., the edge in contact with the block 102 of the papermaking part 100). The chambers 116, 117 and 118 have the respective vacuum ports (a first vacuum port 116', a second vacuum port 117, and a third vacuum port 118', respectively) connected to an external suction means. These vacuum ports can be controlled independently. A net layer 105 hereinafter described is disposed on the cavity 101 of the papermaking part 100.

In molding a pulp molded article by use of the splits shown in FIG. 3, the suction pressure of each of the chambers 116, 117, and 118 can be controlled so as to vary the suction force applied from each hollow chamber to the respective parts of the surface of the cavity 101 through the respective interconnecting holes. Through such suction control, a desired part of the pulp molded article that particularly requires strength can be made thicker. For example, where the suction pressure of only the first hollow chamber is increased, the amount-of pulp fiber deposited on the corresponding part of the cavity 101 which connects with the first hollow chamber can be made larger than that on the other parts of the cavity connecting with the other hollow chambers. It is possible, as a result, to produce a pulp molded article having that part of the wall made thicker.

It is possible to control the wall thickness of the pulp molded article more precisely by providing time lags among the hollow chambers in starting or stopping suction. For example, a pressure gauge (vacuum gauge) is set at each vacuum port, and the hollow chambers 116, 117, and 118 are independently operated under the respective pressures. When the degree of vacuum decreases to a certain set level as pulp fiber is accumulated on the cavity 101, the suction of each of the hollow chambers 116, 117, and 118 is ceased. As a result, waste of suction energy can be avoided.

Suction control failures due to breakage of the net layer 105, clogging of the interconnecting holes 103, a trouble of a suction means, etc. can be monitored by checking the pressure gauge provided for each hollow chamber.

By the use of the split molds shown in FIGS. 2 and 3 pulp molded articles of various shapes can be obtained by exchanging the papermaking part 100. For example, a carton shown in FIG. 4 can be produced in place of the cylindrical bottle shown in FIG. 1(*d*).

Figure 4:
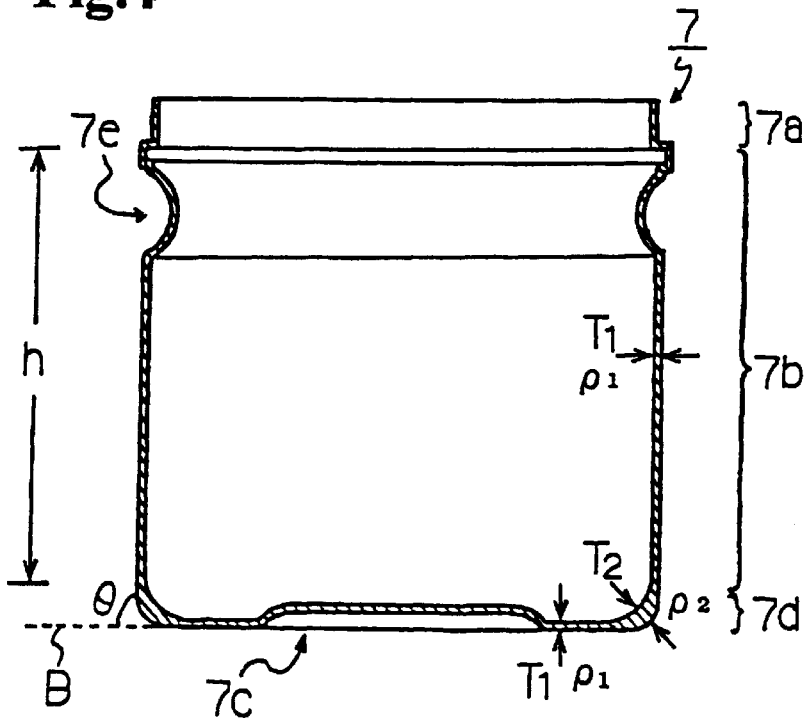
FIG. 4 is a vertical cross section showing an example of pulp molded articles produced according to the present invention.

The pulp molded article 7 shown in FIG. 4 has an opening portion (neck) 7*a* in the upper portion, a body 7*b*, and a bottom 7*c*. The body 7*b* and the bottom 7*c* connect via a curved portion 7*d* to give the molded article 7 increased impact strength. The horizontal cross section of the molded article 7 is almost equal in the height direction and is a rectangle with its four corners rounded to give the molded article 7 increased impact strength and with its four sides gently curved outward. The body 7*b* has a continuous recess 7*e* around its circumference to make the molded body 1 easier to hold.

When the molded article 7 is seen from its side, the outer surfaces (exclusive of the recess 7*e*) of the front and rear walls forming the body 7*b* are straight in the direction of height. Similarly when the molded article 7 is seen from the front, the outer surfaces (exclusive of the recess 7*e*) of the left and right side walls forming the body 7*b* are straight in the direction of height.

In the molded article 7, the angle θ between the plane of contact B of the bottom 7*c* and the outer side wall of the body 7*b* is more than 85°, preferably 89° or more (about 90° in FIG. 4) with respect to any wall of the front and rear side walls and the left and right side walls, and the height h (see FIG. 4) of the body 7*b* is 50 mm or more, preferably 100 mm or more. The angle θ can exceed 90°. Conventional methods of producing pulp molded articles have encountered various restrictions in designing containers, and it has been practically impossible to produce a molded article with such a large rising angle of the side walls and a considerable depth. The method according to the present invention is freed of such inconvenience.

It is preferred for the molded article 7 to have a larger thickness at the corners in its vertical cross section and/or horizontal cross section than the other portion to improve the compressive strength (buckling strength) of the molded article 7 as a whole over the one having equal thickness in these portions. For example, in the vertical cross section of the molded article 7 shown in FIG. 4, the thickness T2 of the corners, i.e., curved bends 7*d*, is preferably greater than the thickness T1 of the body 7*b* (i.e., T2>T1). In this case, where T2/T1 is 1.5 to 2, the improvement on compressive strength of the whole molded article 7 can be secured. It is preferred that the thickness T1 be 0.1 mm or greater for the molded article 7 to exhibit the minimum compressive strength required. It is required for the molded article 7 to have a prescribed compressive strength, considering that the molded articles 7 are to be transported or stacked up in a warehouse or a shop. It is similarly preferred that the molded article 7 has a larger thickness at the corners (T2) in its horizontal cross section (not shown) than the thickness T1 in the other portions.

In cases where the corners of the molded article 7 in the vertical cross section and/or the horizontal cross section satisfy the relationship that their density (ρ2) is smaller than the density (ρ1) of the other portions (i.e., ρ1>ρ2) as well as the above-described relationship between T1 and T2, there is produced an effect that two conflicting phenomena—an improvement in compressive strength of the molded article 7 and a reduction in amount of the material used—can result. This effect is more notable when $0.1\times\rho 1<\rho 2<\rho 1$. The molded article 7 which satisfies these relationships has a compressive strength of 190 N or greater. The compressive strength as referred to here is the maximum strength in compressing the molded article 7 along the direction of height at a speed of 20 mm/min. The above-described relationship between T1 and T2 and between ρ1 and ρ2 can be established by, for instance, properly selecting the pressure or the amount of flow of the pressurizing fluid used in pressing with the pressing member 6, the material or shape of the pressing member 6, the shape of the molded article, and the like in carrying out the aforementioned method.

As stated above, it is easy with the split mold shown in FIG. 3 to make a desired part of a pulp molded article thicker. As an alternative, it is also easy with the split mold shown in FIG. 5 to make a desired part of a pulp molded article thicker.

The split mold shown in FIG. 5 has a papermaking part 100, a manifold part 110, and a mold 120 for creating slurry stagnation (hereinafter "a stagnation-causing mold"). The stagnation-causing mold 120 is inserted into the cavity, which is formed by closing the split molds, to form a space with the inner wall of the cavity in which space the slurry stagnates. The papermaking part 100 and the manifold part 110 have the same structures as shown in FIG. 3.

Figure 5:
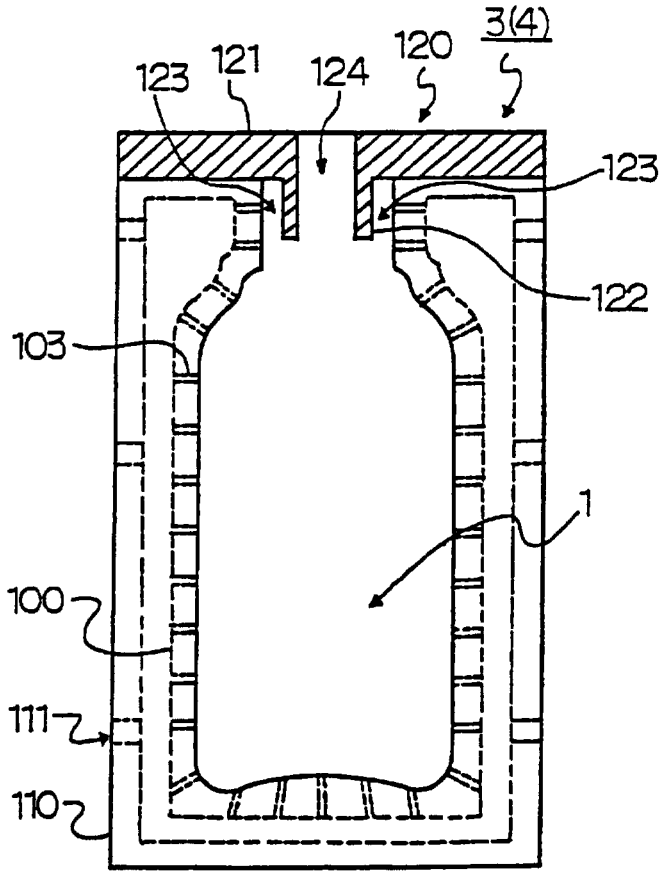
FIG. 5 is a cross sectional view of still another split preferably used in the present invention.

On butting the splits shown in FIG. 5 to each other, there is formed inside a cavity in conformity to the contour of an article to be molded. The part of the cavity that corresponds to the opening portion of the molded article (this part is referred to as "the part of the cavity corresponding to the opening portion" in this embodiment) has an opening open to the outside. Into this part is inserted a wall 122 for making the slurry stagnant (hereinafter "a slurry stagnation wall", described later) of the stagnation-causing mold 120. While not depicted, the inner side of the part of the cavity corresponding to the opening portion has grooves corresponding to the screw thread.

As shown in FIG. 5, the stagnation-causing mold 120 is composed of a rectangular top plate 121 and a cylindrical slurry stagnation wall 122 hanging from approximately the center portion of the lower side of the top plate 121. The slurry stagnation wall 122 forms a hollow cylinder which vertically pierces the stagnation-causing mold 120 and serves as a gate 123 through which a pulp slurry is poured in. The slurry stagnation wall 122 of the stagnation-causing mold 120 is inserted into the part of the cavity corresponding to the opening portion, and the lower side of the top plate 121 and the end of the manifold part 110 are brought into contact to complete the split mold 10.

The outer diameter of the slurry stagnation wall 122 is smaller than the cavity diameter of the part of the cavity corresponding to the opening portion. Therefore, an annular space 123 in which the slurry stagnates is formed between the inner wall of that part of the cavity corresponding to the opening portion and the outer side of the slurry stagnation wall 122 inserted in that part of the cavity corresponding to the opening portion.

Where the molding is carried out by use of the above-described split mold, the pulp slurry goes around to fill the annular space 123 formed between the outer side of the slurry stagnation wall 122 and the inner side of the part of the cavity corresponding to the opening portion and tends to stay there, making the pulp fiber be accumulated there more than on the other parts of the cavity 1. It follows that a pulp deposited body formed on the inner wall of the cavity 1 has a thicker wall in its portion corresponding to the vicinity of the upper edge of the opening portion of a molded article than in the other portions. The thickness of the thicker portion is proportional to the breadth of the annular space 124.

The pulp molded article thus obtained has a thick-walled portion around its neck from its upper edge to a prescribed depth which is thicker than the body and the bottom. The thick-walled portion is continuous along the circumference of the neck. A screw to thread mating a cap is provided on the outer side of the neck. The contour of the vertical cross section of the screw thread can be triangular or rectangular in accordance with the strength of the neck or the productivity of the molded article (e.g., easiness with which the screw thread is dried or easiness with which the shape is transferred). Where the molded article is to be capped and uncapped frequently, the screw thread preferably has a trapezoidal contour. In order to increase the durability against capping and uncapping, the neck including the screw thread may be coated or impregnated with a resin to increase the strength.

The pulp slurry which can be used in the above-described embodiment preferably contains pulp fibers having an average fiber length of 0.8 to 2.0 mm, a Canadian Standard Freeness of 100 to 600 cc, and such a frequency distribution of fiber length as comprises 20 to 90%, based on the total fiber, of fibers whose length ranges from 0.4 mm to 1.4 mm and 5 to 50%, based on the total fiber, of fibers whose length is longer than 1.4 mm and not longer than 3.0 mm. Pulp molded articles obtained from such a pulp slurry are uniform in thickness, free from cracks in papermaking, and excellent in surface smoothness.

It is preferred for the pulp fibers to have an average length of 0.8 to 2.0 mm, particularly 0.9 to 1.8 mm, especially 1.0 to 1.5 mm. If the average fiber length is less than 0.8 mm, cracks tend to develop on the surface of the molded article during papermaking or drying, or the molded article tends to have poor mechanical properties such as impact strength. If the average fiber length exceeds 2.0 mm, the pulp deposited body formed by papermaking tends to have unevenness of thickness only to provide a molded article with poor surface smoothness. The term "average fiber length" as used herein is a value obtained by measuring the frequency distribution of pulp fiber length and calculating a length-weighted fiber length from the distribution.

It is preferred for the pulp fibers to have a freeness of 100 to 600 cc, particularly 200 to 500 cc, especially 300 to 400 cc. A freeness less than 100 cc is so low that speed-up of the molding cycle tends to be difficult, and dewatering of the molded article tends to be insufficient. A freeness exceeding 600 cc is so high that the pulp deposited body formed by papermaking tends to suffer from unevenness of thickness.

Figure 6:
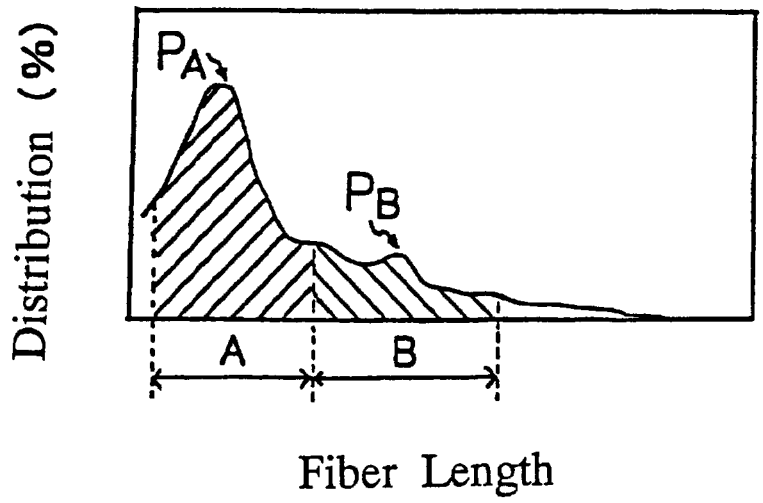
FIG. 6 is a frequency distribution curve of fiber length of pulp fibers preferably used n the present invention.

It is preferred for the pulp fibers to have such a fiber length frequency distribution as comprises 20 to 90%, based on the total fiber, of fibers whose length is within a range of from 0.4 mm to 1.4 mm (hereinafter referred to as range A) and 5 to 50%, based on the total fiber, of fibers whose length is longer than 1.4 mm and not longer than 3.0 mm (hereinafter referred to as range B). FIG. 6 furnishes an example of fiber length frequency distribution curves of pulp fibers preferably used in the method of the present invention. The ratio of the area in range A (indicated with slant lines) to the total area in the frequency distribution curve is equivalent to the proportion (%) of the pulp fibers whose length falls within range A. Similarly, the ratio of the area in range B (indicated with slant lines) to the total area in the frequency distribution curve is equivalent to the proportion (%) of the pulp fibers whose length falls within range B. By using pulp fibers having such a frequency distribution as well as an average fiber length and a freeness falling within the above respective ranges, pulp molded articles uniform in thickness, free from crack development during papermaking, and excellent in surface smoothness can be obtained. It is still preferred that the proportion of the pulp fibers having a fiber length within range A be 30 to 80%, particularly 35 to 65% and that the proportion of the pulp fibers having a fiber length within range B be 7.5 to 40%, particularly 10 to 35%.

To further enhance the above-described effects, it is particularly preferred for the pulp fibers to have such a frequency distribution as has peaks $P_A$ and $P_B$ in ranges A and B, respectively, as represented by FIG. 6.

Pulp fibers having the aforesaid average fiber length, freeness and fiber length frequency distribution can be obtained by selecting, for example, the kind of the fiber (from, e.g., NBKP, LBKP, used paper pulp, etc.), beating conditions, conditions of blending a plurality of pulp kinds, and the like. It is particularly preferred to prepare the above-described pulp fiber by blending relatively long pulp fibers having an average fiber length of 1.5 to 3.0 mm and relatively short pulp fibers having an average fiber length of 0.3 to 1.0 mm at a ratio of 90/10 to 40/60 (by weight) for obtaining a molded article having high surface smoothness.

The above-described pulp slurry can consist of the above-described pulp fiber and water. The pulp slurry can further contain other components, such as inorganic substances, e.g., talc and kaolinite; inorganic fiber, e.g., glass fiber and carbon fiber, synthetic resin powder or fiber, e.g., polyolefin; nonwood or plant fibers; polysaccharides; and the like. The amount of these components is preferably 1 to 70% by weight, particularly 5 to 50% by weight, based on the total amount of the pulp fibers and these components.

The second to tenth embodiments of the present invention are then described with reference to FIGS. 7 through 15. Only the particulars different from the first embodiment will be explained. The description about the first embodiment appropriately applies to the particulars that are not explained here. The members in FIGS. 7 to 15 which are the same as those in FIGS. 1 to 6 are given the same numerical references as used in FIGS. 1 to 6.

In the second embodiment, a net layer composed of a coarse mesh and a fine mesh is put on the surface of each of the splits 3 and 4 of the split mold for papermaking used in the first embodiment, and a pulp slurry is then injected to form a pulp deposited body. In detail, the net layer is composed of a first mesh and a second mesh that is finer than the first mesh. The first mesh is tightly put on the splits 3 and 4, and the second mesh is put on the first mesh. Or, a net layer composed of a first mesh and a second mesh that is finer than the first mesh is used, and the first mesh is tightly put on the splits 3 and 4, and the second mesh is formed on the first mesh. With the fine second mesh put on the coarse first mesh, or with the fine second mesh formed on the coarse first mesh, the number of the interconnecting holes 2 to be bored in the splits 3 and 4 can be decreased, and a pulp deposited body 5 hereinafter described can be accumulated with a uniform thickness.

The first mesh and the second mesh make a coarse net layer and a fine net layer, respectively, and, when put on the splits 3 and 4, are in tight contact with the surface contour of the splits 3 and 4. Each of the first mesh and the second mesh is made of, for example, a natural material, a synthetic resin or a metal or a combination of two or more thereof. The net layers can be given a surface modifying coat to improve the slip properties, heat resistance, and durability. The natural materials include plant fibers and animal fibers. The synthetic resins include thermoplastic resins, thermosetting resins, recycled resins, and semi-synthetic resins.

The average maximum opening width of the first mesh is preferably 1 to 50 mm, particularly 5 to 10 mm. The term "opening width" of the first mesh means the distance between lines of the mesh. If the average maximum opening width is less than 1 mm, the evacuation efficiency is so poor that the pulp fibers are hardly deposited on the surface of the net layer, and a pulp deposited body is hardly formed. If it exceeds 50 mm, the second mesh may pass through between lines of the first mesh to come into contact with the surface of the paper mold. In this case, the evacuation efficiency is reduced in places, resulting in uneven thickness of the pulp deposited body.

The average opening area ratio of the first mesh is preferably 30 to 95%, particularly 75 to 90%. If the average opening area ratio is less than 30%, the evacuation efficiency is so poor that formation of a pulp deposited body is difficult. If it exceeds 95%, the second mesh may come into contact with the surface of the paper mold, which deteriorates the evacuation efficiency in places. As a result, the pulp deposited body will have an uneven thickness.

On the other hand, the average maximum opening width of the second mesh is preferably 0.05 to 1.0 mm, particularly 0.2 to 0.5 mm. The term "opening width" of the second mesh means the inner size between lines of the mesh. If the average maximum opening width is less than 0.05 mm, the evacuation efficiency is so poor that a pulp deposited body is hardly formed. If it exceeds 1.0 mm, the pulp fibers tend to pass therethrough, and it is difficult to form a pulp deposited body.

The average opening area ratio of the second mesh is preferably 30 to 90%, particularly 50 to 80%. If the average opening area ratio is less than 30%, the evacuation efficiency is so poor that a pulp deposited body is hardly formed. If it is more than 90%, the pulp fibers easily pass therethrough, tending to result in difficulty in forming a pulp deposited body.

In this particular embodiment, a net having an average maximum opening width of 3 to 6 mm, an average opening area ratio of 80 to 92%, and a line width of 0.3 mm in the state fitted on the splits 3 and 4 was used as the first mesh. Such a first mesh has an average maximum opening width of 0.08 to 0.25 mm, an average opening area ratio of 46%, and a line width of 0.12 mm in the state before being put on the splits 3 and 4. As the second to mesh, a stocking having an average maximum opening width of 0.22 to 0.35 mm, an average opening area ratio of 58 to 69%, and a line width of 0.06 to 0.07 mm in the state fitted on the splits 3 and 4 was used. Such a second mesh has an average maximum opening width of 0.38 to 0.42 mm, an average opening area ratio of 75%, and a line width of 0.05 to 0.06 mm in the state before being put on the splits 3 and 4. The second mesh does not need to have more rigidity than enough not to come into contact with the surface of the split mold through the openings of the first mesh when the inside of the split mold is evacuated.

Figure 7:
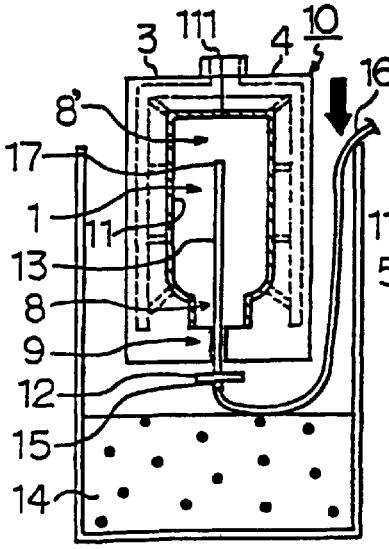
FIG. 7(*a*), FIG. 7(*b*), FIG. 7(*c*), FIG. 7(*d*) and FIG. 7(*e*) schematically show a third embodiment of the present invention, wherein FIG. 7(*a*) is the step of inserting an air feed pipe into a mold and immersing the mold, FIG. 7(*b*) is the step of sucking up a pulp slurry to form a paper layer, FIG. 7(*c*) is the step of feeding air into the cavity and dewatering the pulp deposited body, FIG. 7(*d*) is the step of pulling up the mold and drawing out the air feed pipe, and FIG. 7(*e*) is the step of opening the mold to take out the pulp deposited body.
Figure 7:
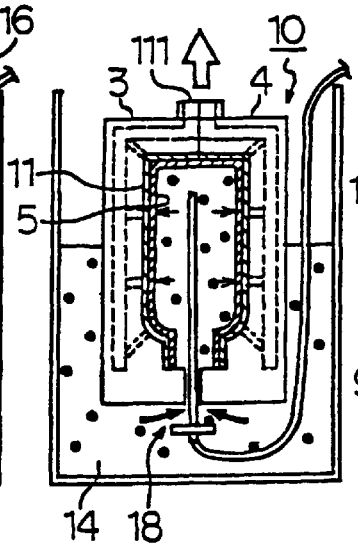
Figure 7:
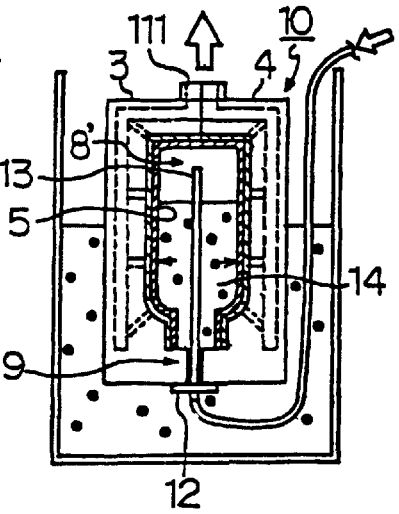
Figure 7:
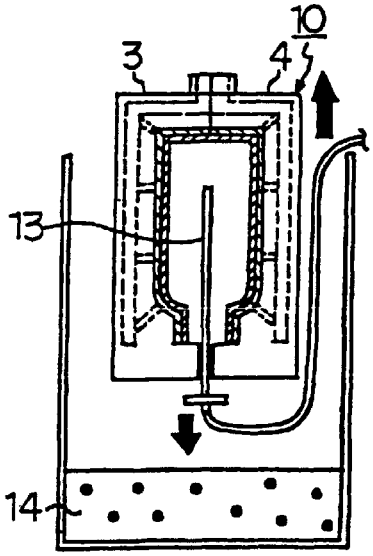
Figure 7:
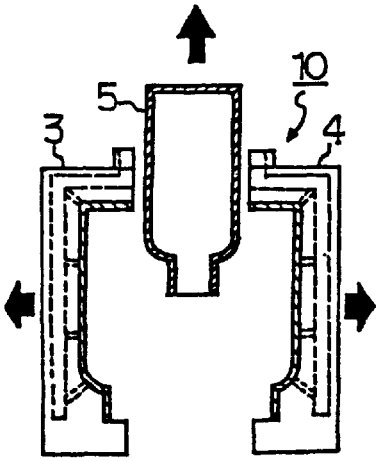

In the third embodiment, the mold 10 shown in FIGS. 7(*a*) through (*e*) is used. The mold 10 is of the type that a set of splits 3 and 4 are butted together to make a cavity 1 in conformity to the outer contour of an article to be molded which has a neck and also to make a slurry inlet gate 9 which connects the part of the cavity corresponding to the neck (the cavity part 8) to the outside.

In the mold 10, the slurry inlet gate 9, which is formed by closing the two splits 3 and 4, has a smaller horizontal cross section area than the cavity part 8 corresponding to the neck. This design has the following advantage. When a pulp slurry is made to flow into the cavity 1 by suction to form a layer of pulp fiber, the pulp fiber layer, especially the pulp fiber layer which will become the neck of a molded article, is effectively prevented from being disturbed by the flow of the slurry into the cavity 1 by suction, and the resulting molded article will have a uniform thickness at the neck.

While depending on the size or shape of the article to be molded, the degree of pulp slurry suction, and the like, the ratio of the cross section area of the slurry inlet gate 9 and that of the cavity part 8 corresponding to the neck is preferably 0.05 to 0.99, particularly 030 to 0.70, with which the wall thickness can be made uniform all over the molded article, and the papermaking efficiency is improved.

The method of producing a pulp molded article having a neck and a closed end (bottom) by use of the above-described mold 10 will be described by referring to FIG. 7. As shown in FIG. 7(*a*), a pair of splits 3 and 4 are butted to each other to make the mold 10 having a cavity 1 with a net layer 11 fitted on the inner side thereof. An air feed pipe 13 having a collar 12 is inserted into the cavity 1 through the slurry inlet gate 9, and the mold 10 having the air feed pipe 13 inserted therein is immersed in a pulp slurry 14 with its slurry inlet gate 9 down. The air feed pipe 13 has a disc-shaped collar 12 near its end 15 to which an air feed hose 16 is connected. The collar 12 is larger than the section area of slurry inlet gate 9 of the mold 10. The air feed hose 16 is connected to an air feed source (not shown). The air feed pipe 13 is inserted into the cavity 1, led by its free end 17. The length of the air feed pipe 13 from the free end 17 to the collar 12 is such that the free end 17 does not reach the part of the cavity 1 corresponding to the bottom (part 8) when the collar 12 is brought into contact with the slurry inlet gate 9.

As shown in FIG. 7(*b*), the pulp slurry 14 is sucked in through a gap 18 between the slurry inlet gate 9 and the collar 12 of the air feed pipe 13 by a suction means (not shown) connected to a vacuum port 111, whereby pulp fibers are built up on the net layer 11 along the inner wall of the cavity 1 to form a pulp deposited body 5 on the net layer 11. The degree of suction, while dependent on the size and shape of the article to be molded, is usually −0.13 to −101.3 kPa for preference, particularly −13.3 to −90.0 kPa.

On forming a pulp deposited body 5 to a prescribed thickness, the slurry inlet gate 9 is blocked by the collar 12 of the air feed pipe 13 as shown in FIG. 7(*c*) to stop the flow of the pulp slurry 14. With the slurry inlet gate 9 blocked by the collar 12, air is forced to be fed to the upper space of the cavity 1 (i.e., the vicinity of the cavity part 8' corresponding to the bottom) through the air feed pipe 13 by means of an air feed source (not shown) while evacuating the cavity 1, whereby the pulp slurry 14 existing in the cavity 1 is discharged outside, and the pulp deposited body 5 is dewatered. Since the evacuation is carried out while feeding air to the upper space of the cavity 1 filled with the pulp slurry 14, the deposited pulp fibers are effectively prevented from being disturbed by the evacuation to provide a molded article with uniform thickness. Since the cross section area of the slurry inlet gate 9 is smaller than that of the cavity part 8 corresponding to the neck, the pulp fibers accumulated on the cavity part 8 corresponding to the neck are effectively prevented from being disturbed by the flow of the pulp slurry 14 thereby to further secure the uniformity in thickness of the neck of the resulting molded article. From the standpoint of shape retention of the pulp deposited body 5 and productivity, it is preferred to conduct the above-described dewatering to such a degree as to reduce the water content of the pulp deposited body 5 to 10 to 95% by weight, particularly 40 to 80% by weight.

After dewatering the pulp deposited body 5 to a predetermined water content, the mold 10 is drawn from the pulp slurry 14 as shown in FIG. 7(*d*), and the air feed pipe 13 in the mold 10 is pull down. Subsequently the mold 10 is opened, and the pulp deposited body 5 is taken out as shown in FIG. 7(*e*). Since the pulp deposited body 5 has been dewatered to a degree enough to have sufficient shape retention by this time, there is no fear of shape deformation when it is taken out. The pulp deposited body 5 is then set in a heating mold heated to a prescribed temperature and heat dried to give a pulp molded article. The heat drying operation can be carried out in the same manner as in the first embodiment.

Figure 8:
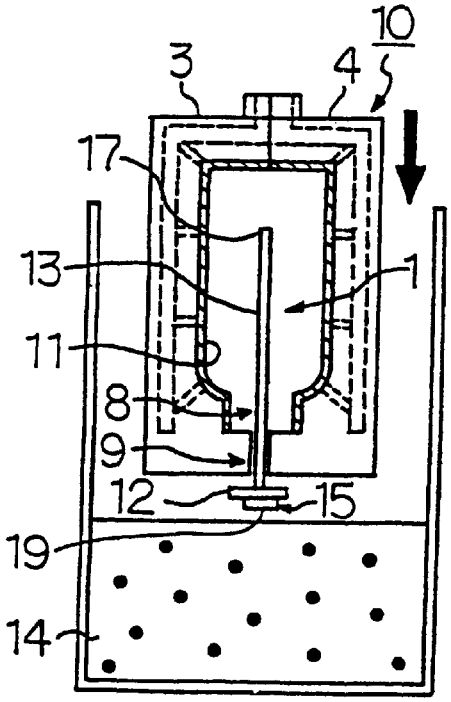
FIG. 8 schematically illustrates the step of inserting an air feed pipe into a mold and immersing the mold in a fourth embodiment of the present invention (corresponding to FIG. 7(*a*)).

In the fourth embodiment, an air feed pipe 13 is used similarly to the third embodiment as shown in FIG. 8. The air feed pipe 13 has a disc-shaped collar 12 near the end 15 similarly to the third embodiment but with no air feed hose connected to that end 15. Instead, the end 15 is blocked by a blocking means 19 to prevent liquid from entering the air feed pipe 13. The air feed pipe 13 is inserted into the cavity 1, led by the other end 17. The mold 10 having the air feed pipe 13 inside is immersed in the pulp slurry 14 with the slurry inlet gate 9 down.

The pulp slurry 14 is sucked in through a gap between the slurry inlet gate 9 and the collar 12 of the air feed pipe 13 while evacuating the cavity 1, whereby pulp fibers are built up on the net layer 11 along the inner wall of the cavity 1 to form a pulp deposited body 5 on the net layer 11.

On forming a pulp deposited body 5 to a prescribed thickness, the slurry inlet gate 9 is blocked by the collar 12 of the air feed pipe 13 to stop the flow of the pulp slurry 14. The evacuation is once stopped simultaneously. The mold 10 with its gate 9 blocked by the collar 12 is drawn from the pulp slurry 14. Subsequently, the blocking means 19 that has been blocking the end 15 of the air feed pipe 13 is removed to let air enter spontaneously through the air feed pipe 13 to the space near the cavity part 8' corresponding to the bottom in the cavity 1 and, at the same time, evacuation is resumed, whereby the water of the pulp slurry 14 contained in the cavity 1 is discharged, and the pulp deposited body 5 is dewatered. In this manner the accumulated pulp fibers are effectively protected from being disturbed by the suction to provide a molded article with a uniform thickness similarly to the case of the third embodiment.

On dewatering the pulp deposited body 5 to a predetermined water content, the air feed pipe 13 inside the mold 10 is pulled down. Thereafter, the same operation as in the third embodiment is carried out to obtain a closed-end pulp molded article having a neck.

The fifth embodiment is practically the same as in the third and fourth embodiments, except that the air feed pipe is not used. In detail, the mold is immersed in a pulp slurry with its slurry inlet gate down. The pulp slurry is sucked up through the gate 9, whereby pulp fibers are accumulated on the net layer provided on the inner wall of the cavity to form a pulp deposited body. On forming a pulp deposited body to a prescribed thickness, evacuation is once stopped, and the mold is pull up from the pulp slurry. The evacuation is resumed to dewater the pulp deposited body. After the water content is reduced to a prescribed level, the mold is opened to take out the pulp deposited body.

Figure 9:
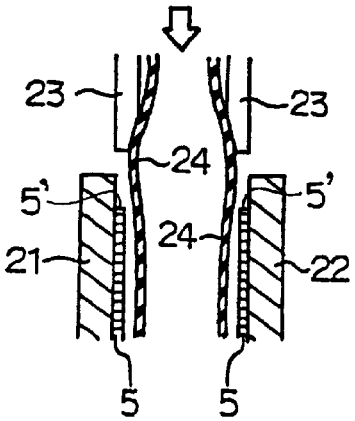
FIG. 9(*a*), FIG. 9(*b*) and FIG. 9(*c*) schematically show a sixth embodiment of the present invention, wherein FIG. 9(*a*) is the step of inserting an edge finishing member, FIG. 9(*b*) is the step of making the opening portion of a pulp deposited body thicker, and FIG. 9(*c*) is the step of pressing the pulp deposited body by a pressing member.
Figure 9:
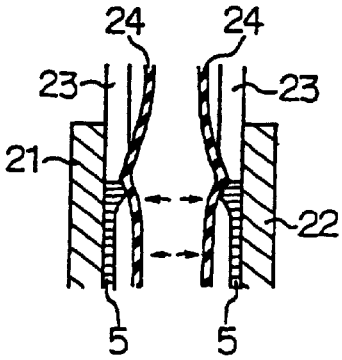
Figure 9:
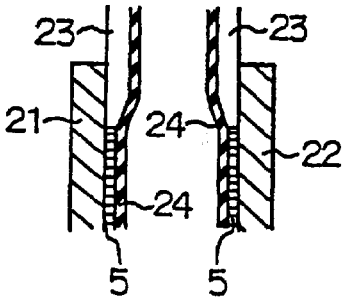

In the sixth embodiment, the pulp deposited body 5 formed in the first embodiment is dewatered under pressure by using the pressing member 6 as described above, and the mold 10 is opened to take out the pressure dewatered pulp deposited body 5, which is then set in a heating mold composed of a set of splits 21 and 22 shown in FIG. 9(*a*). The heating mold has previously been heated to a prescribed temperature. After setting, an edge finishing member 23 comprising a metal-made cylinder, etc. is brought down from above the opening 5' of the pulp deposited body 5. The edge finishing member 23 has a smooth and flat lower end. A part of a pressing member 24 of the same material and the same shape as the pressing member 6 used in the pressure dewatering is fixed to the inner wall of the edge, finishing member 23 near the lower end. In this state the upper edge of the opening 5' of the pulp deposited body 5 is pressed down by the edge finishing member 23, and, at the same time, the pressing member 24 is inserted inside the pulp deposited body 5. As shown in FIG. 9(*b*), it follows that the vicinity of the upper edge is protruded to have an increased thickness, and the shape of the lower end of the edge finishing member 23 is transferred to the upper edge of the opening 5' of the pulp deposited body 5 thereby to make it smooth and flat. A pressurizing fluid is then fed into the pressing member 24 to press the pulp deposited body 5 onto the inner wall of the split mold 21 and 22 via the pressing member 24 as shown in FIG. 9(*c*), whereby the pulp deposited body 5 is shaped in conformity to a desired shape and heat dried. After heat drying, the edge finishing member 23 is pulled up, and the pressing member 24 is also taken out of the pulp deposited body 5. The heating mold is opened to take out the pulp molded article. According to this embodiment, the shape of the opening edge of the pulp molded article can be controlled by appropriately selecting the shape of the lower end of the edge finishing member. As a result, the pulp molded article can have improved sealing properties with a cap, etc. and also improved strength at the opening thereof. In this embodiment, the pressing member 24 does not always need to be fixed to the edge finishing member 23, in which case the pressing member 24 is inserted either before or after the edge finishing member 23 is pressed down. The material and the shape of the pressing member 24 may be the same as or different from those of the pressing member 6 used for pressure dewatering.

Figure 10:
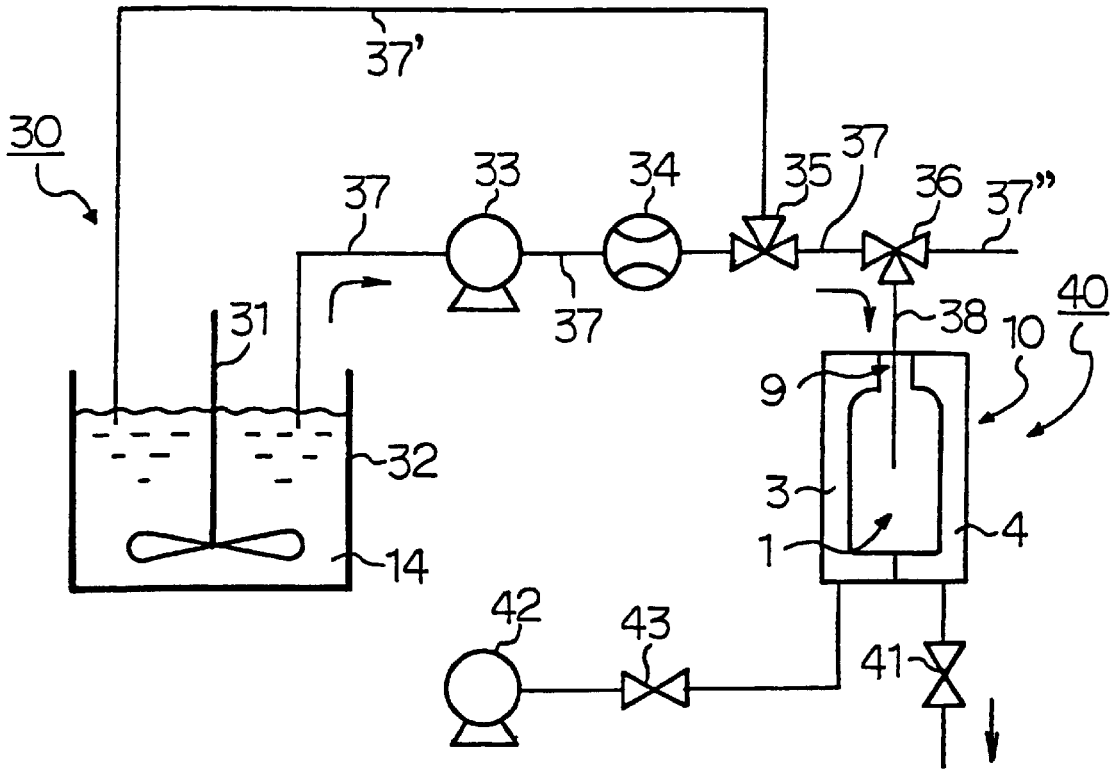
FIG. 10 schematically depicts a molding apparatus used in a seventh embodiment of the present invention.

FIG. 10 is a schematic illustration of a molding apparatus used in the seventh embodiment This molding apparatus is roughly divided into a slurry feed section 30 and a papermaking section 40.

The slurry feed section 30 comprises a slurry storage tank 32 containing a pulp slurry 14, the tank 32 being equipped with a stirrer 31 for the pulp slurry 14, an injection pump 33 which sucks up the slurry 14 from the slurry storage tank 32 and feeds the slurry 14 under pressure into a mold 10, a flow meter 34 which measures the flow amount of the slurry 14, a first three-way valve 35 which switches the flow path of the slurry 14 between the direction to the mold and the direction to the slurry storage tank 32 according to the order given by the flow meter 34, and a second three-way valve 36 which switches the fluid to be fed to the mold 10 between the slurry 14 and air. The slurry storage tank 32, the injection pump 33, the flow meter 34, the first three-way valve 35, and the second three-way valve 36 are connected in series in the order described through piping 37.

The papermaking section 40 comprises a mold 10 composed of a set of splits 3 and 4 for papermaking each having a plurality of interconnecting holes (not shown) which connect the outside and the inside, a drain 41 for discharging water of the slurry injected into the cavity 1, a suction pump 42 which evacuates the cavity 1, and an on-off valve 43 which connects or disconnects the mold 10 and the suction pump 42. The slurry is supplied from the slurry feed section 30 to the cavity 1 through the piping 37 and an in-cavity pipe 38, both the piping 37 and the pipe 38 being connected to the second three-way valve 36. The in-cavity pipe 38 connected to the second three-way valve 36 is inserted into the cavity 1 through a slurry inlet gate 9.

The method of producing molded articles by use of the above-described molding apparatus is described below. First of all, the injection pump 33 is started up to suck up the slurry 14 from the slurry storage tank 32. The slurry 14 passes through the flow meter 34, the first three-way valve 35, and the second three-way valve 36 and is injected under pressure into the cavity 1 of the mold 10. The amount of flow of the slurry 14 is measured with the flow meter 34 in the line. Because the slurry is injected into the cavity 1 under pressure, and the top of the slurry inlet gate 9 is blocked, the water of the slurry injected into the cavity 1 is discharged out of the mold 10 through the interconnecting holes (not shown) which interconnect the inner wall of the cavity 1 to the outside of the mold 10 and through the drain 41. Meantime the pulp fibers of the slurry are deposited on the inner wall of the cavity 1 to form a pulp deposited body (not shown). Since the slurry injection is under pressure as mentioned above, the pressure of the slurry is equalized all over the inner wall of the cavity 1. Therefore, even in obtaining a deep molded article whose side walls rise at nearly right angles, a pulp deposited body of uniform thickness is formed on the inner wall of the cavity 1, and the finally obtained molded article also has a uniform thickness accordingly. Further, since the amount of the slurry to be injected into the cavity 1 is measured in an in line system, papermaking can be performed at a high speed. Furthermore, since the slurry is injected under pressure to cause forced dewatering, the speed of papermaking is further increased.

In order to form a pulp deposited body on the inner wall of the cavity 1 with a uniform thickness and to achieve high-speed papermaking, the pressure for injecting the slurry into the cavity 1 is preferably 0.01 to 5 MPa, particularly 0.01 to 3 MPa After a predetermined amount of the slurry is injected, the flow meter 34 gives an order to the first three-way valve 35 to make a changeover of the flow path. According to this order, the flow path of the first three-way valve 35 is switched over so that the slurry returns to the slurry storage tank 32 through a return pipe 37'.

On completion of the slurry injection, the drain 41 is closed to stop drainage. Also, the second three-way valve 36 is switched to change the flow path to connect an air pressure feed pipe 37" and the in-cavity pipe 38. Air from an air feed source (not shown) is fed into the cavity 1 under pressure through the air pressure feed pipe 37" and the in-cavity pipe 38. Concurrently, the suction pump 42 is started up, and the on-off valve 43 is opened to evacuate the cavity 1. Through this series of operations the water content in the cavity 1 is completely sucked off, and the water content in the pulp deposited body formed on the inner wall of the cavity 1 is also sucked to dewater the pulp deposited body to a prescribed water content. While the pulp deposited body is dewatered by suction, since the inside of the cavity 1 is pressurized by the air, the pulp deposited body is strongly pressed onto the inner wall of the cavity 1. As a result, the thickness of the pulp deposited body is leveled more uniformly, and the configuration of the inner side of the cavity 1 is transferred to the pulp deposited body with good precision. Also, dewatering by suction is conducted quickly.

In order to make the thickness of the pulp deposited body more uniform and to achieve quick dewatering, the pressure for feeding air into the cavity 1 is preferably 0.01 to 5 MPa, particularly 0.01 to 3 MPa After the pulp deposited body is formed in the cavity 1, the in-cavity pipe 38 is drawn out A pressing member similar to the pressing member 6 used in the first embodiment is inserted into the cavity 1 to dewater the pulp deposited body under pressure. Subsequently, the mold 10 is heated to heat dry the pulp deposited body. Alternatively, the mold 10 is opened to take out the pulp deposited body, which is heat dried in a separately prepared heating mold to obtain a pulp molded article.

Figure 11:
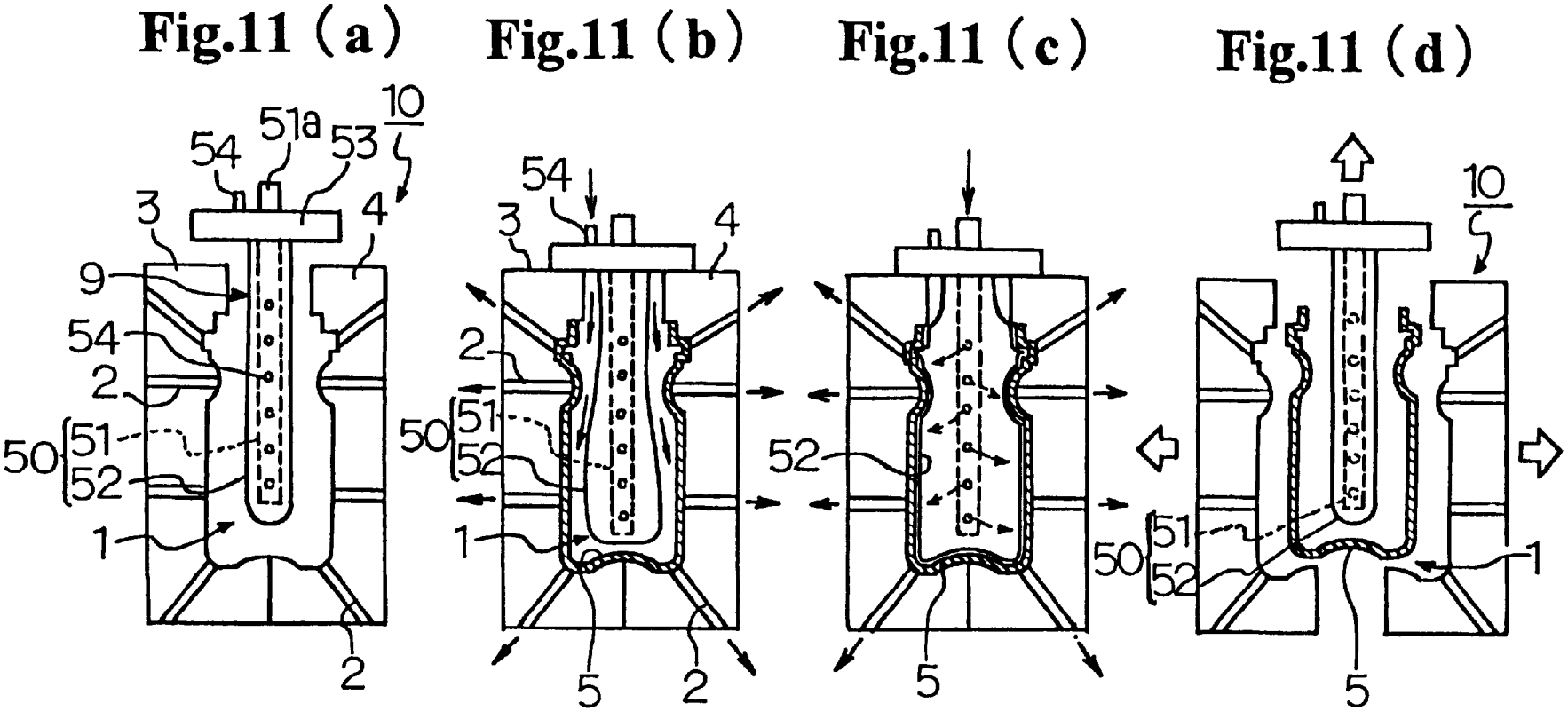
FIG. 11(*a*), FIG. 11(*b*), FIG. 11(*c*) and FIG. 11(*d*) schematically show an eighth embodiment of the present invention, wherein FIG. 11(*a*) is the step of inserting an insert member, FIG. 11(*b*) is the step of preliminarily expanding a covering member, FIG. 11(*c*) is the step of pressure dewatering a pulp deposited body, and FIG. 11(*d*) is the step of opening the mold and taking out the pulp deposited body.

In the eighth embodiment, an insert member 50 is inserted into the cavity 1 through the slurry inlet gate 9 of the mold 10 as shown in FIG. 11(*a*). The cavity configuration of the mold used in this embodiment is conformed to the contour of a carton. The insert member 50 has a supporting member 51 and a hollow or bag-like covering member 52 with which the supporting member 51 is covered. Both the supporting member 51 and the covering member 52 are fixed to a clamp plate 53 with a prescribed means. The supporting member 51 is cylindrical and has a large number of holes 54 on its side. The supporting member 51 has its end 51a projected outside through the clamp plate 53 and connected to a pressurizing fluid feed source (not shown). There is thus formed a passageway in the insert member 50 from the end 51*a* of the supporting member 51, through the inside of the supporting member 51 and the holes 54 on the side wall of the supporting member 51 to the inside of the covering member 52. The covering member 52 is made of a hollow, stretchable elastic member or a nonstretchable bag. Where the covering member 52 is made of an elastic member, the elastic member exhibits elasticity irrespective of whether or not it has a supporting member 51 therein, so that it is easy to keep the elastic member off the inner wall of the cavity 1 in the preliminary expansion hereinafter described. Where, on the other hand, the covering member 52 is made of a nonstretchable bag, the inside of the supporting member 51 is evacuated to bring the bag close to the supporting member 51 so as keep the bag off the inner wall of the cavity 1 while the pulp deposited body is formed. In this particular embodiment, an elastic member is used as the covering member 52. The elastic member can be made of urethane, fluorine rubber, silicone rubber, elastomers, etc., which are excellent in tensile strength, impact resilience, stretchability, and the like. The nonstretchable bag can be of polyethylene, polypropylene, etc.

With the insert member 50 inserted in the cavity 1 and with the slurry inlet gate 9 blocked by the clamp plate 53, a prescribed pressurizing fluid is supplied from a pressurized fluid source into the inside of the covering member 52 through the above-described passageway as shown in FIG. 11(*b*), thereby to preliminarily expand the covering member 52 to a prescribed size. The covering member 52 thus expanded preliminarily has an almost flat plate shape. The term "expand" as used herein means that the covering member 52 stretches to increase its volume (for example, in the case where the covering member 52 is made of a stretchable elastic member) and that the covering member 52 is not stretchable per se but capable of increasing its volume (for example, in the case where the covering member 52 is made of a nonstretchable bag which is in close contact with the supporting member 51 in an evacuated state). The term "inflate" as used herein has the same meanings.

The above-described preliminary expansion brings about an increase of the volume of the insert member 50, resulting in a reduction of the capacity of the cavity 1. This means that the water content of the pulp slurry injected in the cavity 1 decreases. Compared with what would result with no insert member SO, a higher concentration pulp slurry can be injected, and the cavity 1 can be filled with the pulp slurry in a shorter time. As a result, the molding cycle time including the pulp slurry injection time can be shortened. Because the volume of the insert member 50 can be increased within the cavity 1, the insert member 50 works effectively even in the production of bottles whose cross section at the neck is smaller than the cross section of the body. It is preferred that the capacity of the cavity 1 be decreased by preliminary expansion to 5 to 90%, particularly 40 to 75%, of the capacity before the insertion of the insert member 50.

While the covering member 52 is in a preliminarily expanded state, any part of the insert member 50 is not in touch with the inner wall of the cavity 1 as depicted in FIG. 11(*b*). Scatter of thickness of the pulp deposited body 5 is thus suppressed. In this state, a slurry is injected into the cavity 1 through a pulp slurry inlet 54 of the clamp plate 53, whereupon the water content of the pulp slurry is discharged out of the mold 10 through the interconnecting holes 2, and pulp fibers are accumulated on the inner wall of the cavity 1. As a result, there is formed a pulp deposited body 5 built up of the pulp fiber on the inner wall of the cavity 1.

After a predetermined amount of the pulp slurry has been injected, the feed is stopped, and the cavity 1 is completely evacuated for dewatering. Then, as shown in FIG. 11(*c*), the pressurizing fluid is further fed into the covering member 52 to further expand the covering member 52, by which the pulp deposited body 5 is pressed onto the inner wall of the cavity 1 and dewatered under pressure. It is preferred for the pulp deposited body 5 be dewatered by suction to a water content of 70 to 80% by weight and be further dewatered by pressing with the covering member 52 until the water content is reduced to 55 to 70%. Since injection of the pulp slurry into the cavity 1 is immediately followed by pressure dewatering, the time for mechanical operation can be reduced, leading to a reduction of the molding cycle time as compared with the embodiment where an injection nozzle is drawn after the slurry is injected, and an elastic member for pressure dewatering is then inserted. The pressure for feeding the pressurizing fluid for pressure dewatering is preferably 0.01 to 5 MPa, particularly 0.1 to 3 MPa.

After the configuration of the inner side of the cavity 1 is sufficiently transferred to the pulp deposited body 5, and the pulp deposited body 5 is dewatered to a prescribed water content, the pressurizing fluid in the covering member 52 is withdrawn, whereupon the covering member 52 contracts to its original size as shown in FIG. 11(*d*). The insert member 50 is taken out of the cavity 1, and the mold 10 is opened to remove the pulp deposited body 5 having a prescribed water content. The pulp deposited body 5 is subsequently subjected to heat drying in the same manner as in the first embodiment.

Figure 12:
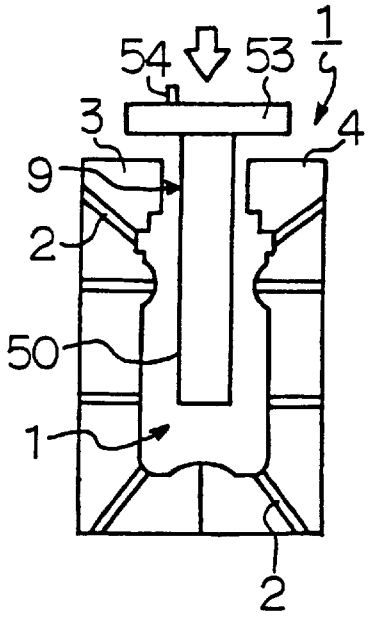
FIG. 12 schematically shows the step of inserting an insert member in a ninth embodiment of the present invention (corresponding to FIG. 11(*a*)).

The ninth embodiment, shown in FIG. 12, is the same as the eighth embodiment except for the construction of the pressing member and the step of pressing and dewatering the pulp deposited body.

As shown in FIG. 12, an insert member 50 is inserted into the cavity 1 of the mold 10 which is composed of a set of splits 3 and 4 butted to each other. The insert member 50 used in this embodiment is a rod having some thickness which is fixed at one end thereof to a clamp plate 53. In FIG. 12 is shown the side view of the rod. The rod is required to have such a volume as to reduce the capacity of the cavity 1 sufficiently when it is inserted into the cavity 1. From the standpoint of improvement on efficiency, for example, reduction of the molding cycle time, it is preferred to use a rod having such a volume as to reduce the capacity of the cavity 1 to 5 to 90%, particularly 40 to 75%. As long as this requirement is met, the rod may be either solid or hollow. When the insert member 50 is in an inserted state, any part of the insert member 50 is not in touch with the inner wall of the cavity 4 similarly in the eighth embodiment.

With the insert member 50 inserted and the slurry inlet gate 9 blocked, a pulp slurry is injected into the cavity 1 through a pulp slurry inlet 54. The water of the pulp slurry is discharged out of the mold 10 through the interconnecting holes 2, and pulp fibers are deposited on the inner wall of the cavity 1 to form a pulp deposited body. The pulp slurry may be injected through the inside of the insert member 50.

On injecting a predetermined amount of the pulp slurry, the injection is stopped, and the cavity 1 is completely evacuated for dewatering. Then, the insert member 50 is drawn from the cavity 1. Thereafter the pulp deposited body is subjected to pressure dewatering and heat drying in the same manner as in the first embodiment.

The tenth embodiment will now be described This embodiment presents an example of production of a multilayered pulp molded article having an outermost layer and an innermost layer.

Figure 13:
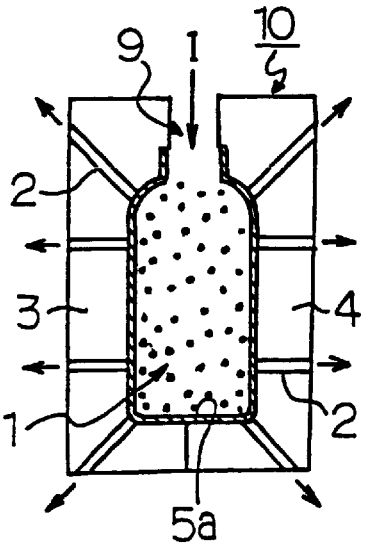
FIG. 13(*a*), FIG. 13(*b*) and FIG. 13(*c*) illustrate a tenth embodiment of the present invention, wherein FIG. 13(*a*) is the step of injecting a first pulp slurry under pressure, FIG. 13(*b*) is the step of injecting a second pulp slurry under pressure, and FIG. 3(*c*) is the step of pressure dewatering.
Figure 13:
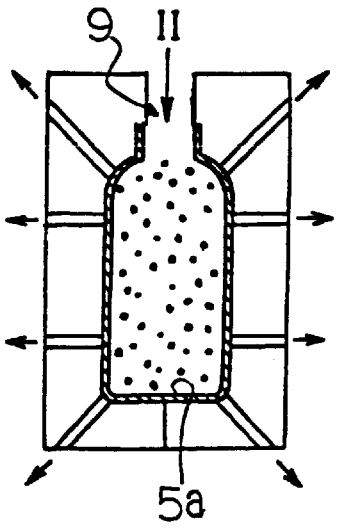
Figure 13:
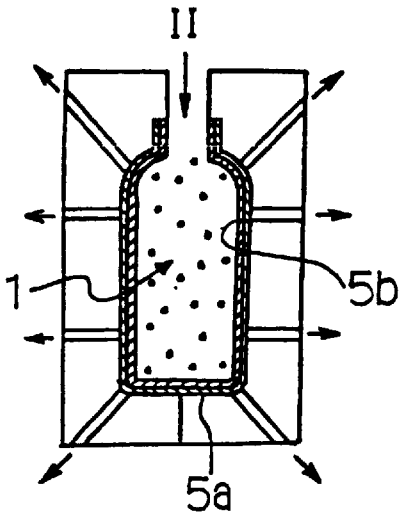

As shown in FIG. 13(*a*), a predetermined amount of a first pulp slurry I is injected under pressure into the cavity 1 of the mold 10 through the slurry inlet gate 9. Pressure injection of the first pulp slurry I can be done by means of, e.g., a pump. The injection pressure of the first pulp slurry I is preferably 0.01 to 5 MPa, still preferably 0.01 to 3 MPa.

The cavity 1 being pressurized, the water of the first pulp slurry is discharged out of the mold 10, while the pulp fibers are accumulated on the inner wall of the cavity 1 to form a first pulp layer Sa as an outermost layer on the inner wall of the cavity 1 as shown in FIG. 13(*b*). A second pulp slurry II different from the first pulp slurry I in composition is then injected under pressure into the cavity 1 through the slurry inlet gate 9 of the mold 10. As a result, there is a mixed slurry comprising the first pulp slurry and the second pulp slurry in the cavity 1. The injection pressure of the second pulp slurry II can be about the same as that of the first pulp slurry I.

While the second pulp slurry is injected under pressure, dewatering from the cavity 1 is continued to form a mixed pulp layer (not shown) comprising the components of the mixed slurry on the first pulp layer 5*a*. Since the proportion of the second to the first pulp slurries in the mixed slurry increases continuously with time, the composition of the mixed layer formed on the first pulp layer 5*a* continuously changes from first pulp slurry-rich to second pulp slurry-rich compositions.

As the second pulp slurry II is injected under pressure while continuing pressure dewatering as shown in FIG. 13(*c*), the composition of the mixed slurry in the cavity 1 finally becomes equal to the composition of the second pulp slurry. Eventually, as shown in the Figure, a second pulp layer 5*b* comprising the component of the second pulp slurry is formed on the mixed layer as an innermost layer.

In the production method according to this embodiment, injection of the first pulp slurry I and that of the second pulp slurry II into the cavity 1 are continuous so that the molded articles can be produced efficiently.

The first and the second pulp slurries are not particularly limited in kind as long as they have different compositions.

After the second pulp layer 5*b* is formed to a prescribed thickness, the pressure injection of the second pulp slurry is ceased, and air is introduced into the cavity 1 under pressure for dewatering. The thus obtained pulp deposited body is subjected to pressure dewatering and heat drying in the same manner as in Example 1 to obtain a multilayered pulp molded article.

Figure 14:
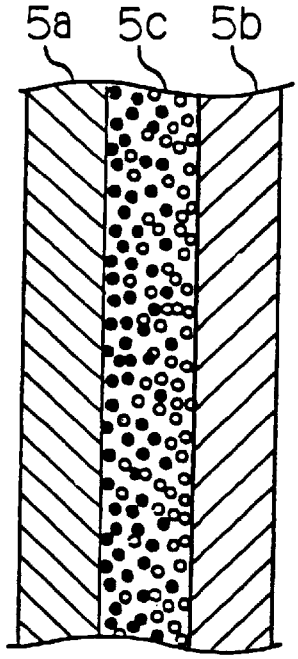
FIG. 14 is a schematic view showing the multilayered structure of a pulp molded article obtained in the tenth embodiment.

The multilayered structure of the molded article obtained by the present embodiment is as shown in FIG. 14. Between the first pulp layer 5*a* as an outermost layer and a second pulp layer 5*b* as an innermost layer, there exists a mixed layer 5*c* whose composition continuously changes from that of the first pulp layer to that of the second pulp layer. As a result, the adhesion strength between the first pulp layer 5*a* and the second pulp layer 5*b* is increased, and separation of these layers is prevented effectively. The existence of the mixed layer 5*c* between the first pulp layer 5*a* and the second pulp layer 5*b* can be confirmed by microscopic observation of the cross section of the molded article.

The thicknesses of the first pulp layer 5*a*, the mixed layer 5*c* and the second pulp layer 5*b* are decided appropriately according to the use of the molded article and the like. Where, in particular, pulp fiber of low whiteness is used as an inner layer, it is preferred for the outermost layer (the first pulp layer 5*a* in this particular embodiment) to have a thickness of 5 to 50%, especially 10 to 50% of the total thickness of the molded article in order to secure sufficient hiding properties. The thickness of each layer depends on the amounts and the concentrations of the first and second pulp slurries.

Having a multilayer structure, the molded article obtained in this embodiment can have different functions served by the individual layers. For example, only the first pulp layer 5*a* as the outermost layer can be made a colored layer by incorporating a colorant, such as a pigment or a dye, or colored Japanese paper or a colored synthetic fiber into the first pulp slurry. In case where pulp having a relatively low whiteness, for example, pulp obtained from used paper, such as de-inked pulp, is compounded into the first pulp slurry (e.g., to a whiteness of 60% or more, particularly 70% or more), incorporating the colorant only into the first pulp slurry is advantageous in that the tone of that slurry can be adjusted with ease, the amount of the colorant to be compounded can be minimized, and the molded articles can be produced at a lower cost. The amount of the colorant to be added is preferably 0.1 to 15% by weight based on the pulp fiber. Further, the amount of de-inked pulp is reduced, making the molded article inexpensive.

Where a slurry comprising hard wood bleached pulp (LBKP) is used as the first pulp slurry, the resulting molded article has improved surface smoothness and suitability to printing or coating.

Incorporating additives, such as waterproofing agents, water repellents, water-vaporproofing agents, fixing agents, oilproofing agents, antifungal agents, antimicrobial agents, antistatic agents, and the like, into the first pulp slurry imparts the respective functions to the first pulp layer 5*a* as the outermost layer. It is preferred for the first pulp layer 5*a* containing these additives as the outermost layer to have a surface tension of 10 dyn/cm or less and a water repellency of R10 (JIS P 8137). Further, incorporating a particulate or fibrous thermoplastic synthetic resin to the first pulp slurry imparts abrasion resistance to the first pulp layer 5*a* to suppress fluffing and the like. The degree of abrasion resistance is preferably 3H or more in terms of pencil hardness (JIS K 5400).

It is particularly preferred for the pulp slurry to be used for forming the first pulp layer 5*a* as the outermost layer to contain pulp fibers having an average fiber length of 0.2 to 1.0 mm, particularly 0.25 to 0.9 mm, especially 0.3 to 0.8 mm, a Canadian Standard Freeness of 50 to 600 cc, particularly 100 to 500 cc, especially 200 to 400 cc, and such a frequency distribution of fiber length as comprises 50 to 95%, particularly 60 to 95%, especially 70 to 95%, based on the total fiber, of fibers whose length ranges from 0.4 mm to 1.4 mm (range A). Using such a pulp slurry brings about improved transfer of the inner configuration of the cavity.

It is preferred for the pulp slurry to be used for forming the second pulp layer 5*b* as the innermost layer to contain pulp fibers having an average length of 0.8 to 2.0 mm, particularly 0.9 to 1.8 mm, especially 1.0 to 1.5 mm, a Canadian Standard Freeness of 100 to 600 cc, particularly 200 to 500 cc, especially 300 to 400 cc, and such a frequency distribution of fiber length as comprises 20 to 90%, particularly 30 to 80%, especially 35 to 65%, based on the total fiber, of fibers whose length ranges from 0.4 mm to 1.4 mm (range A) and 5 to 50%, particularly 7.5 to 40%, especially 10 to 35%, based on the total fiber, of fibers whose length is more than 1.4 mm and not more than 3.0 mm (range B). Using such a pulp slurry effectively prevents development of cracks and thickness unevenness during papermaking. It is particularly preferred for enhancement of the above effects that the frequency distribution curve has a peak in each of ranges A and B. Where such a pulp slurry is used, the thickness of the innermost layer is preferably 30 to 95%, still preferably 50 to 90%, of the total thickness.

Where it is desired to obtain a certain characteristic by addition of a specified additive or pulp fiber, this can be achieved by adding the additive, etc. only to a specific layer where the desired characteristic is manifested most efficiently. This is advantageous in that the amount of the additive, etc. can be reduced as compared with the production of a monolayer pulp molded article.

Figure 15:
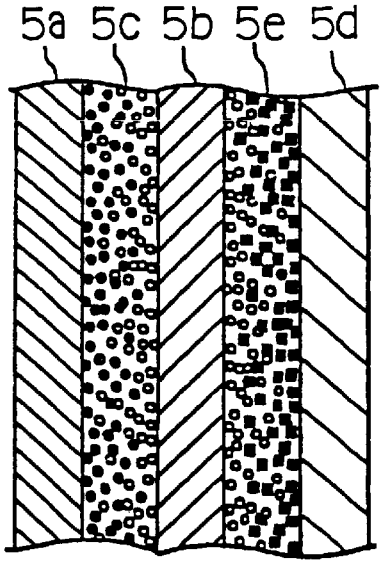
FIG. 15 is a schematic view showing the multilayered structure of another pulp molded article obtained in the 10th embodiment (corresponding to FIG. 14).

According to the present embodiment, it is possible to produce a pulp molded article having more layers than the layer structure shown in FIG. 14. For example, as shown in FIG. 15, a third pulp layer 5*d* different in composition from both of the second pulp layer 5*b* and the first pulp layer 5*a* is formed on the side of the second pulp layer 5*b* shown in FIG. 14, and a mixed layer 5*e* whose composition continuously changes from the composition of the second pulp layer 5*b* to that of the third pulp layer 5*d* is formed between the second pulp layer 5*b* and the third pulp layer 5*d*, making five layers in all. In this case, a multilayered molded article made up of a plurality of materials is obtained. In another case, another first pulp layer 5*a*' is formed on the side of the second pulp layer 5*b* shown in FIG. 14, and a mixed layer 5*c*' whose composition continuously changes from the composition of the second pulp layer 5*b* to that of the first pulp layer 5*a*' is formed between the second pulp layer 5*b* and the first pulp layer 5*a*', making five layers in all in which the innermost layer and the outermost layer have the same composition. In this case, making the first pulp layers 5*a* and 5*a*' of pulp having high whiteness and making the second pulp layer 5*b* of pulp having such whiteness as of used paper provide a molded article which has an appearance of high whiteness and yet is competitive in price.

The present invention is not limited to the above-described embodiments so that the steps, apparatus, members and the like in each of the above-described embodiments are interchangeable with each other. The molds that can be used in the present invention may be composed of a set of two or three or more splits in accordance with the shape of articles to be molded. The same applies to the heating molds.

EXAMPLES

The present invention will now be illustrated in greater detail, but it should be understood that the scope of the present invention is not construed as being limited thereto.

Examples 1 to 5

Bottles were molded by the method shown in FIG. 1. The particulars of the pulp in the slurry used are shown in Table 1 below. Molding properties in the molding are also shown in the Table. In Table 1, the LBKP used in Examples 1 to 4 is used paper used in OA equipment, which contains a large amount of virgin pulp and has a small freeness, while the LBKP used in Example 5 is CENIBRA (trade name), which contains a large amount of recycled pulp with a small amount of virgin pulp and has a large freeness.

TABLE 1

| Ex. No. | Raw Material | Avg. Fiber Length (mm) | Freeness (cc) | Fiber Length Frequency Distribution Range A | Fiber Length Frequency Distribution Range B | Molding Properties |
|---|---|---|---|---|---|---|
| 1 | used paper | 1.50 | 390 | 43.4 | 28.5 | good |
| 2 | NBKP/LBKP*1 = 70/30*2 | 1.29 | 350 | 57.5 | 22.0 | good |
| 3 | used paper/ LBKP*3 = 50/50*2 | 0.92 | 350 | 73.4 | 9.2 | good |
| 4 | used paper LBKP*3 = 30/70*2 | 0.87 | 450 | 77.4 | 7.6 | good |
| 5 | used paper/ LBKP*4 = 50/50*2 | 0.92 | 450 | 79.7 | 8.0 | good |

*1Average fiber length of NBKP: 2.29 mm; average fiber length of LBKP: 0.82 mm
*2Weight ratio
*3Average fiber length of used paper: 1.5 mm; average fiber length of LBKP: 0.82 mm
*4Average fiber length of used paper: 1.5 mm; average fiber length of LBKP: 0.81 mm As is apparently seen from the results in Table 1, the molded articles of Examples 1 to 5 prepared from a slurry containing pulp having a specific average fiber length, a specific freeness, and a specific fiber length frequency distribution show satisfactory molding properties. While not shown in the Table, the molded articles of Examples 2, 3 and 5 made of a blend of long pulp fibers and short pulp fibers had particularly excellent surface smoothness.

Examples 6 to 9

A slurry for outermost layer containing 1.0% by weight of pulp fiber the physical properties of which are shown in Table 2 was injected into the cavity of the mold shown in FIG. 13 through the slurry inlet gate under a pressure of 0.3 MPa. The cavity was dewatered to form an outermost layer of the slurry for outermost layer on the inner wall of the cavity. Concurrently with the formation of the outermost layer, a slurry for innermost layer containing 1.0% of pulp fiber whose physical properties are shown in Table 2 was injected into the cavity under a pressure of 0.3 MPa. Air is introduced into the cavity through the slurry inlet gate under a pressure of 0.1 MPa to form, on the outermost layer, a mixed layer of which the composition continuously changed from that of the slurry for outermost layer to that of the slurry for innermost layer and, on the mixed layer, an innermost layer was further formed of the slurry for innermost layer. A pressing member comprising an elastic member was inserted into the thus obtained pulp deposited body, and air was fed into the pressing member under a pressure of 1.5 MPa to press the pulp deposited body onto the inner wall of the cavity for dewatering.

The mold was opened to take out the pulp deposited body, which was then set in a heating mold having the same cavity configuration as the shaping mold. A pressing member comprising an elastic member is inserted into the pulp deposited body set in the heating mold. Air was introduced into the pressing member under a pressure of 1.5 MPa to press the pulp deposited body onto the inner wall of the cavity while heating the heating mold at 200° C. to dry the pulp deposited body. After the pulp deposited body dried sufficiently, the heating mold was opened to remove the molded bottle. The molding properties of the resulting molded article are shown in Table 2. The surface roughness of the molded article was measured with Surfcom 120A available from Tokyo Seimitsu K.K. The transfer properties of the inner cavity configuration to the molded article were evaluated with the naked eye. A 70 mm long by 20 mm wide piece was cut out of the resulting molded article. The cut piece was partly separated along the mixed layer to prepare a Y-shaped specimen. The specimen was set on a tensile tester with a chuck distance of 20 mm and peeled at a peel angle of 180° and a pulling speed of 30 mm/min. The results of the peel test are shown on Table 2. All these results obtained are shown in Table 2.

Examples 10

A bottle was molded in the same manner as in Example 6, except that the slurry for outermost layer was injected into the cavity to complete formation of the outermost layer, and then the slurry for innermost layer was injected into the cavity to form an innermost layer on the outermost layer. The resulting molded article had no mixed layer between the outermost layer and the innermost layer. The same measurements as described above were made on the resulting molded article. The results obtained are shown in Table 2.

TABLE 2

| | Pulp Fiber of Slurry for Innermost Layer | | | | Pulp Fiber of Slurry for Outermost Layer | | | Thickness (μm) | | | Evaluation | | | |
|---|---|---|---|---|---|---|---|---|---|---|---|---|---|---|
| Ex. No. | Avg. Fiber Length (mm) | Freeness (cc) | Fiber Length Frequency Distribution (%) Range A | Range B | Avg. Fiber Length (mm) | Freeness (cc) | Fiber Length Frequency Distribution (%): Range A | Innermost Layer | Mixed Layer | Outermost Layer | Molding Properties | Surface Roughness Ra (μm) | Transfer Properties* | Layer Separation |
| 6 | 1.50 | 310 | 43.4 | 28.5 | 0.64 | 280 | 72.8 | 300 | 100 | 100 | good | 2–3 | A | not observed |
| 7 | 1.50 | 310 | 43.4 | 28.5 | 0.64 | 280 | 72.8 | 200 | 100 | 200 | good | 2–3 | A | not observed |
| 8 | 1.50 | 310 | 43.4 | 28.5 | 0.48 | 100 | 56.3 | 300 | 100 | 100 | good | 1–2 | A | not observed |
| 9 | 1.50 | 310 | 43.4 | 28.5 | 0.93 | 400 | 73.0 | 300 | 100 | 100 | good | 3–5 | B | not observed |
| 10 | 1.50 | 310 | 43.4 | 28.5 | 0.64 | 280 | 72.8 | 350 | 0 | 150 | good | 2–3 | A | slightly observed |

*A: Neither cracking nor fluffing was observed.
B: No cracks developed, but fluffing was observed.

It is apparently seen from the results shown in Table 2 that the molded articles of Examples of which the innermost and outermost layers are formed by using slurries containing pulp fiber having specific physical properties are prevented from developing cracks or unevenness of thickness (development of a part whose thickness is half or less the average thickness or a part with such a reduced thickness as can be perceived when held up to the light) and have excellent surface smoothness. In particular, the molded articles of Examples 6 to 9 having a mixed layer formed between the innermost layer and the outermost layer have an increased peel strength between the innermost layer and the outermost layer as compared with the molded article of Example 10.

INDUSTRIAL APPLICABILITY

The present invention provides a method of producing a pulp molded article which enables designing a complicated shape and integrally molding an opening portion, a body portion, and a bottom portion with no joint seams. The production method of the present invention is applicable to not only hollow containers to put things in but other objects such as omaments.

What is claimed is:

1. A pulp molded article obtainable by a process comprising:

supplying a pulp slurry into a cavity of a mold composed of a set of splits, the set of splits being assembled together to form said cavity with a prescribed configuration, to form a pulp deposited body, feeding a fluid into said cavity to press said pulp deposited body onto an inner wall of said cavity thereby dewatering said pulp deposited body, wherein said pulp slurry contains pulp fibers selected from the group consisting of wood pulp fibers which are softwood pulp fibers or hardwood pulp fibers and non-wood pulp fibers having a length-weighted average fiber length of 0.8 to 2.0 mm, a Canadian Standard Freeness of 100 to 600 cc, and a frequency distribution of fiber length as follows: 20 to 90%, based on the total fiber content have lengths from 0.4 mm to 1.4 mm, and 5 to 50%, based on the total fiber content have lengths longer than 1.4 mm and not longer than 3.0 mm.

2. A pulp molded article obtainable by a process comprising:

supplying a pulp slurry into a cavity of a mold composed of a set of splits, the set of splits being assembled together to form said cavity with a prescribed configuration, to form a pulp deposited body, feeding a fluid into said cavity to press said pulp deposited body onto an inner wall of said cavity thereby dewatering said pulp deposited body, said pulp molded article having an outermost layer and an innermost layer, wherein the pulp slurry used to form said innermost layer contains pulp fibers having a length-weighted average fiber length of 0.8 to 2.0 mm, a Canadian Standard Freeness of 100 to 600 cc, and a frequency distribution of fiber length as follows: 20 to 90%, based on the total fiber content of the innermost layer, have fiber lengths from 0.4 mm to 1.4 mm, and 5 to 50%, based on the total fiber content of the innermost layer, have lengths longer than 1.4 mm and not longer than 3.0 mm, and wherein the pulp slurry used to form said outermost layer contains pulp fibers having a length-weighted average fiber length of 0.2 to 1.0 mm, a Canadian Standard Freeness of 50 to 600 cc, and such a frequency distribution of fiber length as comprises 50 to 95%, based on the total fiber content of the outermost layer, of fibers whose length ranges from 0.4 mm to 1.4 mm.

3. The pulp molded article as claimed in claim 2, wherein said pulp slurry is a pulp slurry containing pulp fibers selected from the group consisting of non-wood pulp fibers, softwood pulp fibers and hardwood pulp fibers, and further comprising a mixed layer which is located in between said outermost layer and said innermost layer, wherein said mixed layer has a composition that continuously changes from that of said outermost layer to that of said innermost layer.

* * * * *